US008529318B2

(12) United States Patent
Matsuda

(10) Patent No.: US 8,529,318 B2
(45) Date of Patent: Sep. 10, 2013

(54) SHARPENER

(75) Inventor: Satoshi Matsuda, Kyoto (JP)

(73) Assignee: KYOCERA Corporation, Kyoto (JP)

( * ) Notice: Subject to any disclaimer, the term of this patent is extended or adjusted under 35 U.S.C. 154(b) by 611 days.

(21) Appl. No.: 12/732,090

(22) Filed: Mar. 25, 2010

(65) Prior Publication Data

US 2010/0248598 A1 Sep. 30, 2010

(30) Foreign Application Priority Data

Mar. 26, 2009 (JP) ..... 2009-077088
Nov. 26, 2009 (JP) ..... 2009-268245
Jan. 27, 2010 (JP) ..... 2010-015205

(51) Int. Cl.
*B24B 23/04* (2006.01)

(52) U.S. Cl.
USPC ..... 451/356; 451/162

(58) Field of Classification Search
USPC ..... 451/351, 356, 162
See application file for complete search history.

(56) References Cited

U.S. PATENT DOCUMENTS 5,749,770 A * 5/1998 Uzumcu et al. ..... 451/28
5,759,093 A * 6/1998 Rodriguez ..... 451/356
6,379,236 B1 * 4/2002 Takizawa et al. ..... 451/490
6,659,851 B2 * 12/2003 Takahashi et al. ..... 451/356
2011/0275294 A1 * 11/2011 Lien ..... 451/540

FOREIGN PATENT DOCUMENTS

JP 4-109860 9/1992
JP 2004-083558 10/2005

* cited by examiner

*Primary Examiner* — Dung Van Nguyen
(74) *Attorney, Agent, or Firm* — Procopio, Cory, Hargreaves & Savitch LLP

(57) ABSTRACT

A sharpening device operable to maintain a stable angle of a cutting edge during sharpening is disclosed. A sharpening member reciprocates parallel to a first direction. The sharpening member comprises a sharpening surface comprising at least one groove along the first direction. Reciprocation can reduce a presence of a sharpening residue on the sharpening surface while maintaining a stable sharpening angle of a cutting edge.

19 Claims, 24 Drawing Sheets

5

SHARPENER

CROSS-REFERENCE TO RELATED APPLICATION

The present application claims priority under 35 U.S.C. §119 to Japanese Patent Application No. 2009-077088, filed on Mar. 26, 2009, entitled SHARPENER, Japanese Patent Application No. 2009-268245, filed on Nov. 26, 2009, entitled SHARPENER, and Japanese Patent Application No. 2010-015205, filed on Jan. 27, 2010, entitled SHARPENER, each of which is incorporated by reference herein in its entirety.

FIELD

An embodiment of the present disclosure relates generally to a sharpener, and more particularly to a sharpener that sharpens a cutting edge of a cutting device.

BACKGROUND

A sharpening device generally modifies a cutting edge of a cutting device to an appropriate shape. The sharpening device generally operates by grinding or abrading away material on the cutting edge with an abrasive substance harder than the material of the cutting edge. A polishing process may also be applied to the cutting edge to increase smoothness and correct for possible deformations.

A manual sharpener generally comprises a sharpening stone comprising a sharpening surface with abrasive grains and a surface without abrasive grains, the surface without abrasive grains comprises a groove. The groove generally extends along a direction substantially perpendicular to a sharpening direction. With the manual sharpener, a sharpening residue generated by sharpening with the sharpening stone may remain on the sharpening surface, and may reduce an effectiveness of the sharpening surface.

An electric knife sharpener generally comprises a rotational sharpening member coupled to an output shaft of an electric motor. The rotational sharpening member rotates and contacts the cutting edge of the cutting device, thereby sharpening the cutting edge of the cutting device. In the electric knife sharpener, the cutting edge to be sharpened may be repelled by the rotational sharpening member. If the cutting edge is repelled, an angle at which the cutting edge is sharpened may not be stable, thereby reducing a cutting quality of the cutting edge.

Therefore, there is a need for a sharpener that maintains a stable angle of the cutting edge during sharpening.

SUMMARY

A sharpening device operable to maintain a stable angle of a cutting edge during sharpening is disclosed. A sharpening member reciprocates parallel to a first direction. The sharpening member comprises a sharpening surface comprising at least one groove along the first direction. Reciprocation can reduce a presence of a sharpening residue on the sharpening surface while maintaining a stable sharpening angle of a cutting edge.

A first embodiment comprises a sharpener. The sharpener comprises a sharpening member reciprocating in a first direction and comprising a sharpening surface with a groove along the first direction.

A second embodiment comprises a sharpener. The sharpener comprises sharpening means operable to reciprocate in a first direction and comprising a sharpening surface with a groove along the first direction.

A third embodiment comprises a method of sharpening. The method comprises reciprocating a sharpening member in a first direction, the sharpening member comprising a sharpening surface with a groove along the first direction.

BRIEF DESCRIPTION OF THE DRAWINGS

Embodiments of the present disclosure are hereinafter described in conjunction with the following figures, wherein like numerals denote like elements. The figures are provided for illustration and depict exemplary embodiments of the present disclosure. The figures are provided to facilitate understanding of the present disclosure without limiting the breadth, scope, scale, or applicability of the present disclosure. The drawings are not necessarily made to scale.

DETAILED DESCRIPTION OF EXEMPLARY EMBODIMENTS

The following description is presented to enable a person of ordinary skill in the art to make and use the embodiments of the disclosure. The following detailed description is exemplary in nature and is not intended to limit the disclosure or the application and uses of the embodiments of the disclosure. Descriptions of specific devices, techniques, and applications are provided only as examples. Modifications to the examples described herein will be readily apparent to those of ordinary skill in the art, and the general principles defined herein may be applied to other examples and applications without departing from the spirit and scope of the disclosure. Furthermore, there is no intention to be bound by any expressed or implied theory presented in the preceding technical field, background, brief summary or the following detailed description. The present disclosure should be accorded scope consistent with the claims, and not limited to the examples described and shown herein.

Embodiments of the disclosure are described herein in the context of one practical non-limiting application, namely, a knife sharpener. Embodiments of the disclosure, however, are not limited to such sharpeners, and the techniques described herein may also be utilized in other applications. For example, embodiments may be applicable to broach sharpeners, pencil sharpeners, and the like.

As would be apparent to one of ordinary skill in the art after reading this description, these are merely examples and the embodiments of the disclosure are not limited to operating in accordance with these examples. Other embodiments may be utilized and structural changes may be made without departing from the scope of the exemplary embodiments of the present disclosure.

Figure 1:
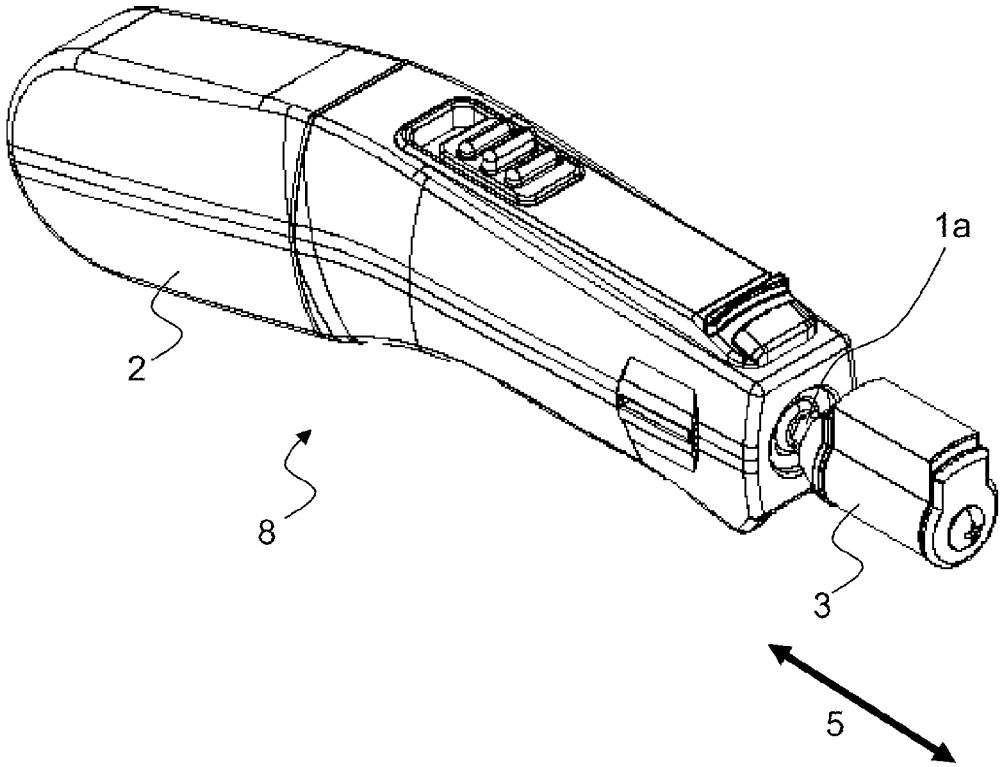
FIG. 1 is an illustration of a perspective view of an exemplary sharpener according to an embodiment of the present disclosure.
Figure 2:
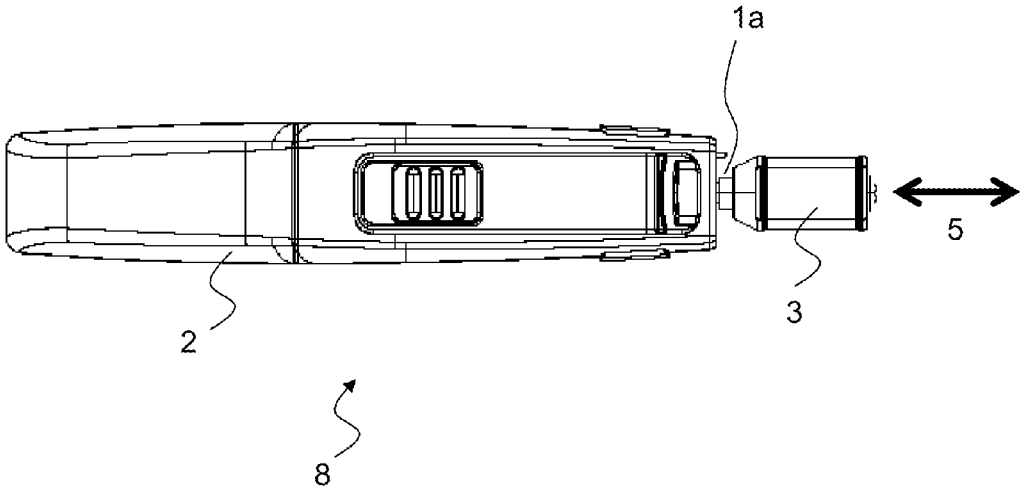
FIG. 2 is an illustration of a top view of the sharpener shown in FIG. 1.
Figure 3:
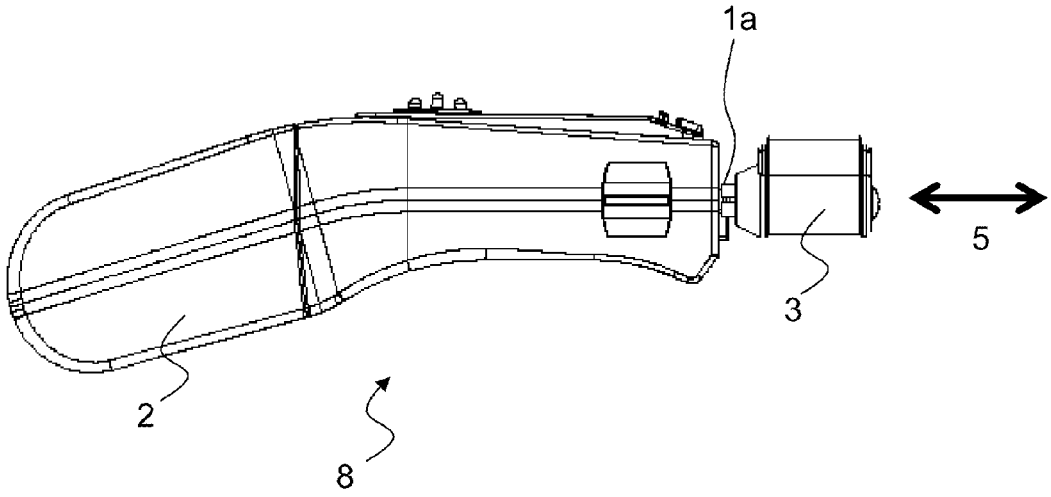
FIG. 3 is an illustration of a side view of the sharpener shown in FIG. 2.

FIG. 1 is an illustration of a perspective view showing an exemplary sharpener 8 according to an embodiment of the present disclosure. FIG. 2 is a top view of the sharpener 8. FIG. 3 is a side view of the sharpener 8.

The sharpener 8 comprises a grip 2 and a sharpening member 3. The sharpening member 3 is coupled to an output shaft 1*a* extending from the grip 2 to the outside. The sharpening member 3 reciprocates in a first direction 5.

Figure 4:
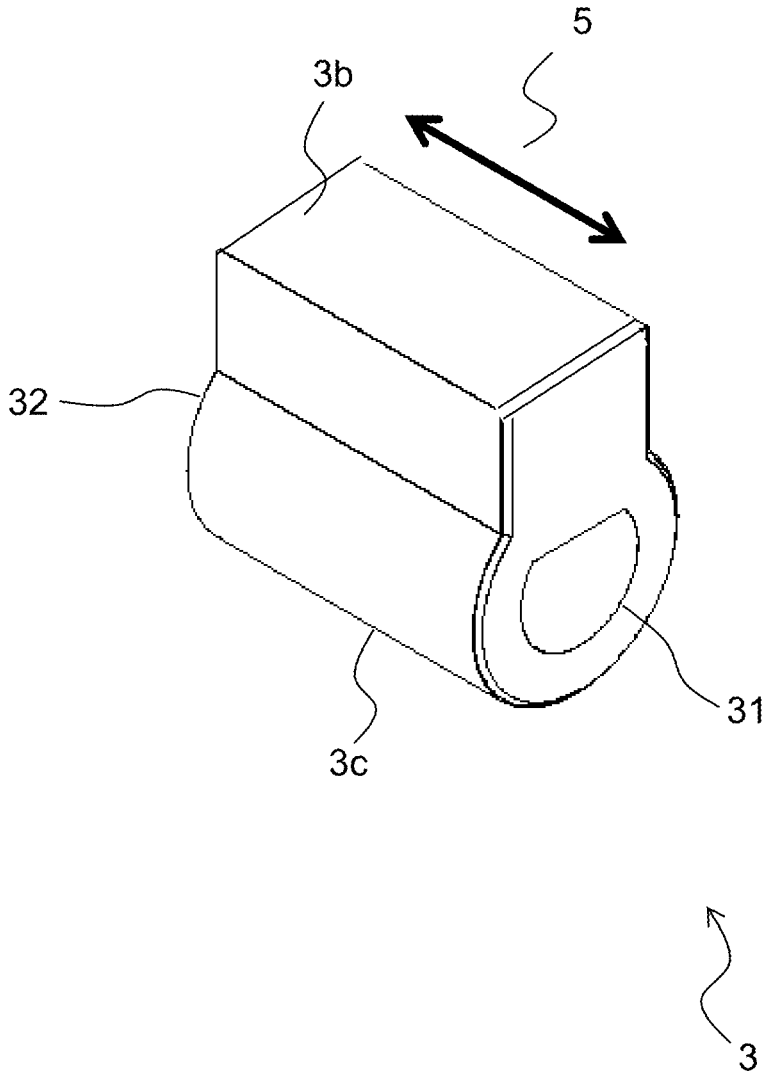
FIG. 4 is an illustration of a perspective view of an exemplary sharpening member according to an embodiment of the present disclosure.
Figure 5:
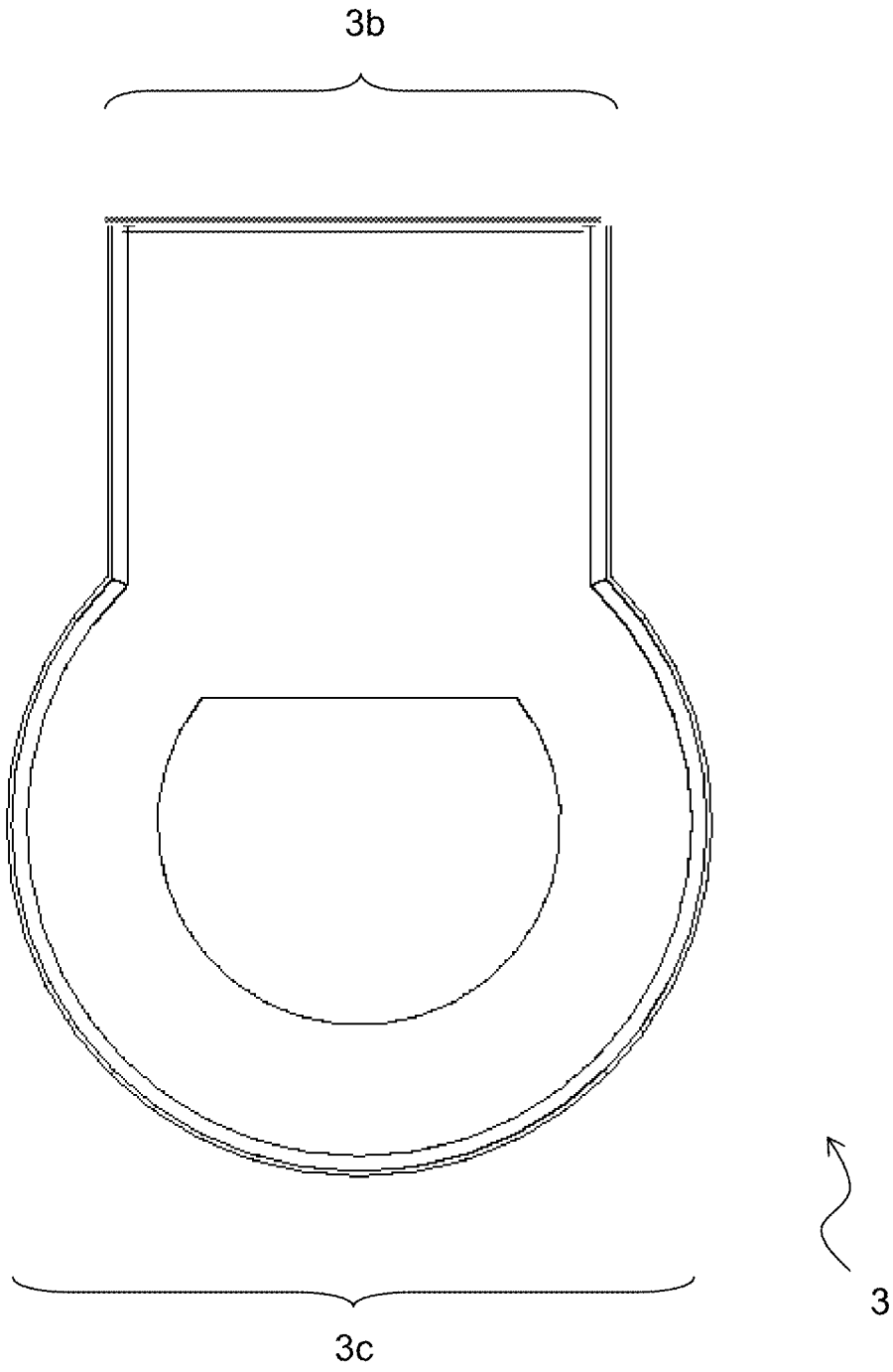
FIG. 5 is an illustration of a front view of the sharpening member shown in FIG. 4.
Figure 6:
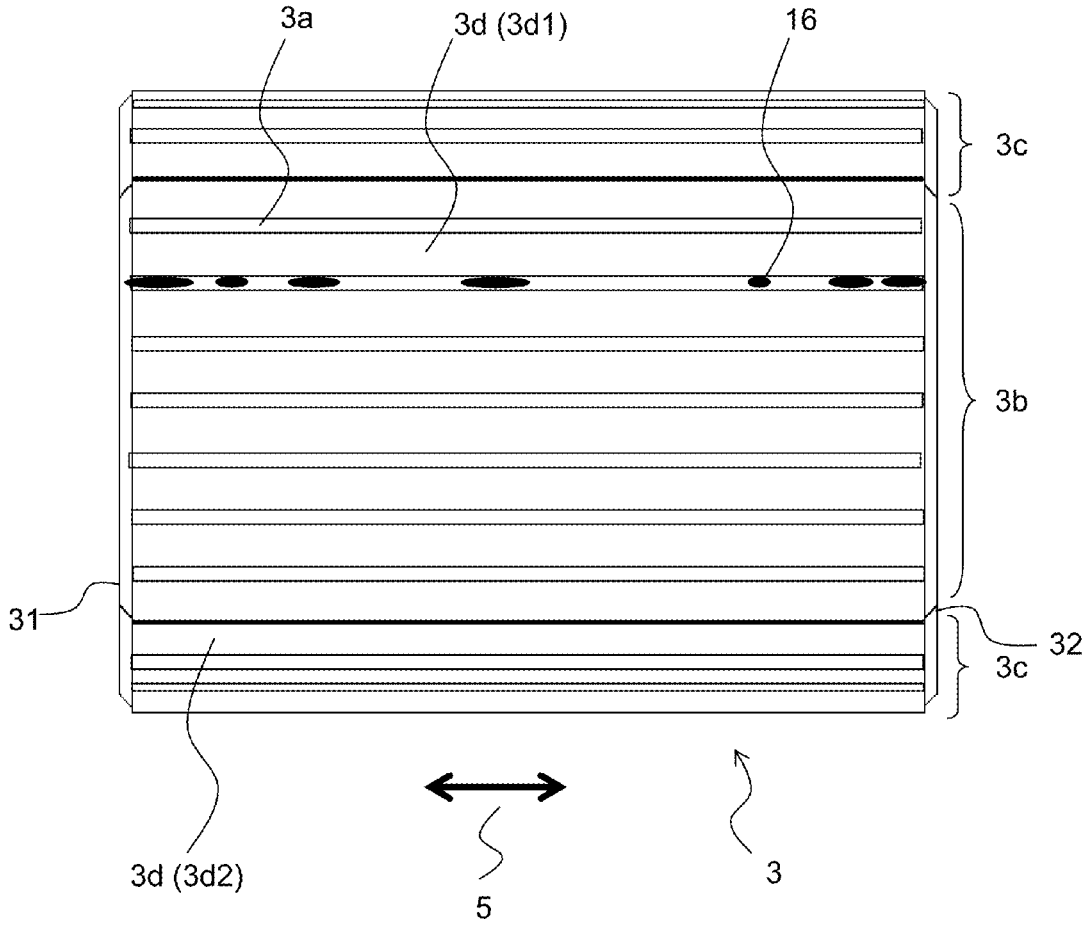
FIG. 6 is an illustration of a top view of the sharpening member shown in FIG. 4.
Figure 7:
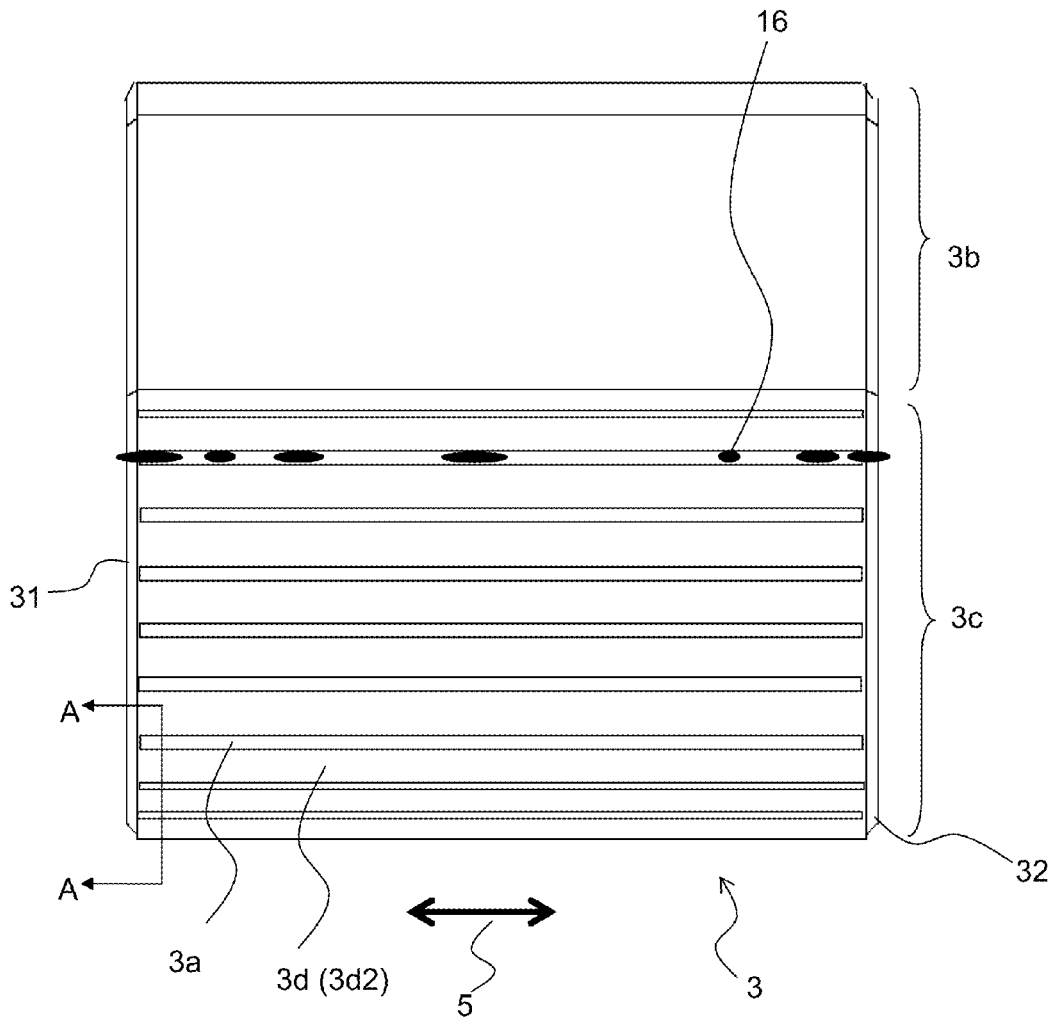
FIG. 7 is an illustration of a side view of the sharpening member shown in FIG. 4.
Figure 8:
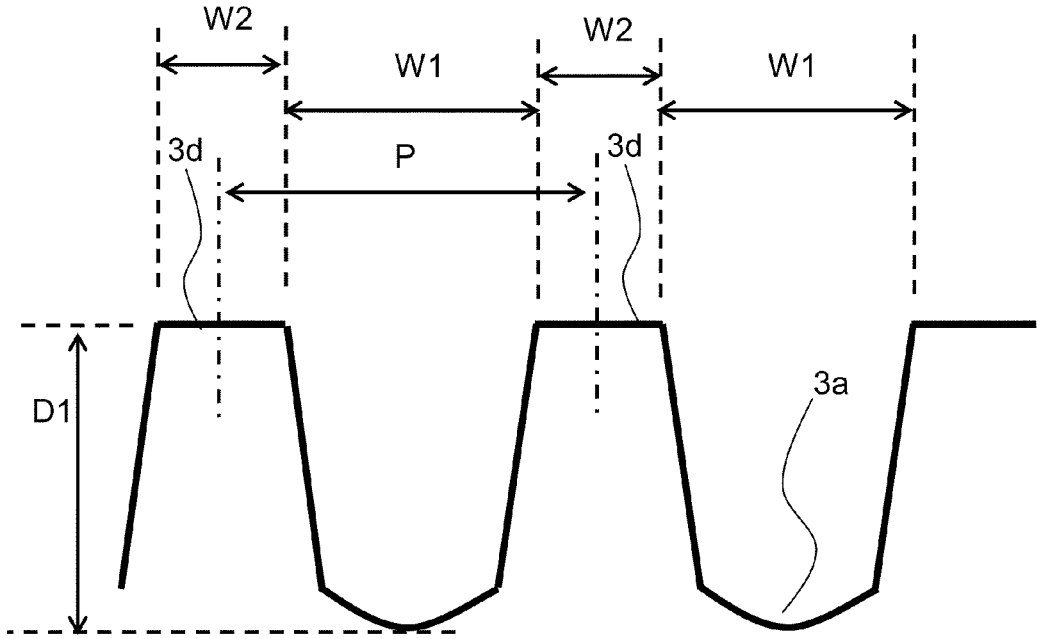
FIG. 8 is an illustration of a fragmentary sectional view taken along line A-A of the sharpening member shown in FIG. 7.

FIG. 4 is an illustration of a perspective view of the exemplary sharpening member 3. FIG. 5 is an illustration of a front view of the sharpening member 3. FIG. 6 is an illustration of a top view of the sharpening member 3. FIG. 7 is an illustration of a side view of the sharpening member 3. FIG. 8 is an illustration of a fragmentary sectional view taken along line A-A in FIG. 7.

Referring to FIGS. 4 and 5, the sharpening member 3 is a columnar member, and comprises a flat portion 3*b* and a curved portion 3*c*. Referring to FIGS. 6 and 7, the flat portion 3*b* and the curved portion 3*c* each comprise a sharpening surface 3*d* and a plurality of the grooves 3*a*.

The sharpening surface 3*d* sharpens a cutter 15. The sharpening surface 3*d* is substantially parallel to the first direction 5 of the sharpening member 3.

The plurality of the grooves 3*a* extends along the first direction 5, specifically. Specifically, the grooves 3*a* extend substantially in parallel to the first direction 5 of the sharpening member 3. Referring to FIG. 8, the grooves 3*a* have a uniform width W1. The grooves 3*a* are arranged substantially in parallel to one another at a uniform interval P. Hence, a portion of the sharpening surface 3*d* between the adjacent two grooves 3*a* has a substantially uniform width W2.

Each of the grooves 3*a* of the sharpening member 3 may have a width W1 ranging from about 0.4 to about 0.5 mm, and a depth D1 ranging from about 0.1 to about 0.3 mm. Accordingly, sharpening residue 16 can be easily removed to the outside of the sharpening member 3.

Referring to FIG. 8, if the sharpening surface 3*d* is a flat surface, the width W1 of each of the grooves 3*a* may be a substantially maximum dimension of the groove 3*a*, a dimension which is parallel to the sharpening surface 3*d*, and the depth D1 of the groove may be a substantially maximum dimension of the groove 3*a*, a dimension which is perpendicular to the sharpening surface 3*d*.

Referring to FIGS. 6 and 7, in a process of sharpening the cutter 15 with the sharpening member 3, sharpening residue 16 is generated at a position near the center of the sharpening member 3. Part of the generated sharpening residue 16 may enter the grooves 3*a*. The sharpening residue 16 moves from the center toward both ends of the grooves 3*a* by swinging due to the reciprocation of the sharpening member 3 in the first direction 5, and is removed to the outside of the sharpening member 3.

That is, the reciprocation of the sharpening member 3 causes the sharpening residue 16 to be vibrated. Accordingly, the sharpening residue 16 in the grooves 3*a* of the sharpening member 3 is easily removed without being clogged in the grooves 3*a*.

Accordingly, the amount of sharpening residue 16 staying in the sharpening surface of the sharpening member 3 is decreased, and likelihood of appearance of spots on a cutting edge 15*a* is decreased, and smooth sharpening is provided.

In other words, since the sharpening member 3 comprising the grooves 3*a* reciprocates, the sharpening residue 16, which deeply enters the grooves 3*a* and hence is hardly removed merely by a centrifugal force, can be easily removed. The sharpening residue 16 can be more smoothly removed to the outside as the sharpening member 3 reciprocates more frequently. For example, if the motion of the sharpening member 3 is like supersonic oscillation, the sharpening residue 16 can be easily removed to the outside of the sharpening member 3.

As the reciprocation of the sharpening member 3 becomes more frequent, a variation in angle θ (described below) defined by the cutter 15 and the sharpening member 3 can be reduced during sharpening.

The reciprocation of the sharpening member 3 may be provided by, for example, an electric motor. In particular, the sharpening member 3 may reciprocate in the first direction 5 by rotation of the electric motor.

As shown in FIGS. 6 and 7, the shape of each of the grooves 3*a* in plan view is linear. However, the shape of the groove 3*a* is not limited thereto. The grooves 3*a* are disposed on the sharpening surface 3*d* so as to extend along the first direction 5.

The expression "the groove extends along the first direction" can be referred to include both cases as described below. First case is in which an auxiliary line is arranged along the first direction when the auxiliary line is a line connecting the center points in the widths of the groove, the widths correspond to each width of the groove at some arbitrary points in the first direction. The second case is in which the maximum difference between the center points in the direction perpendicular to the first direction is less than the maximum width of the groove. Therefore, the shape of the groove 3*a* may be, for example but without limitation, curved in plan view, and the like. In addition, a single groove 3*a* may be split in midcourse into a plurality of grooves 3*a*, or the grooves 3*a* may be joined in midcourse, depending on the type of the cutter 15.

Figure 24A:
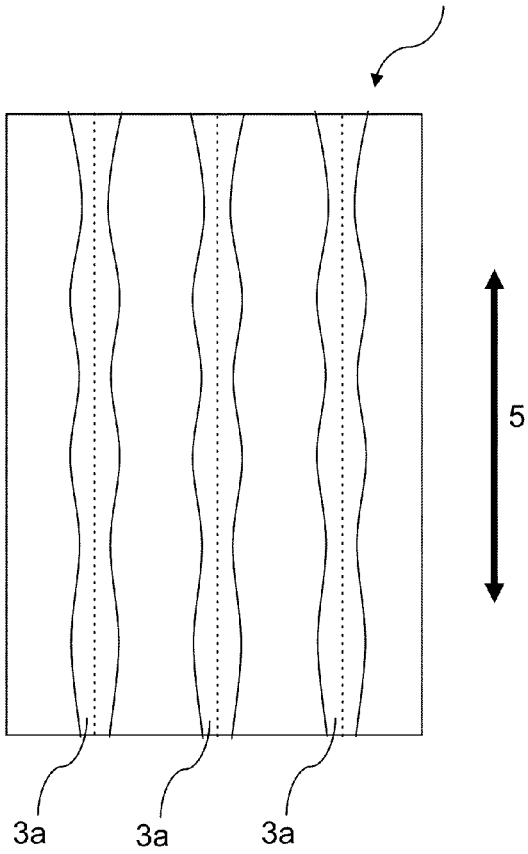
FIG. 24A is an illustration of a plan view of an exemplary sharpening member according to an embodiment of the present disclosure.
Figure 24B:
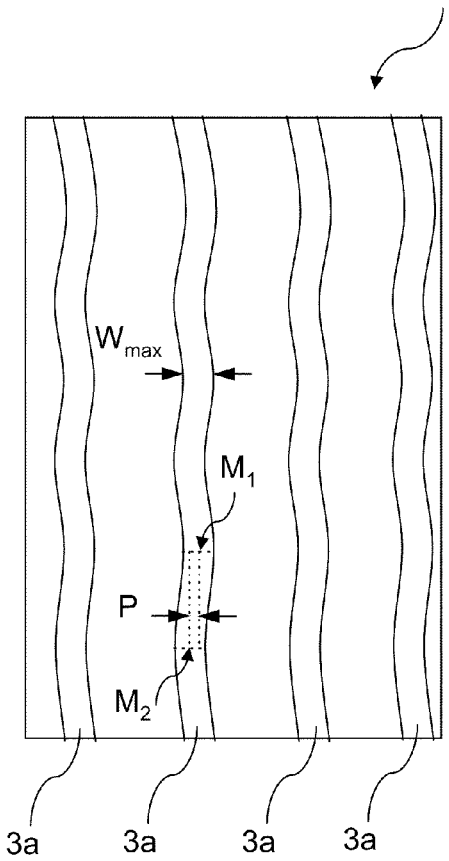
FIG. 24B is an illustration of a plan view of an exemplary sharpening member according to an embodiment of the present disclosure

FIGS. 24A and 24B illustrate other exemplary shapes of the groove 3*a* according to an embodiment to the present disclosure. Specifically, FIGS. 24A and 24B illustrate the fist and the second case described above respectively. In FIG. 24A, the auxiliary line described above is shown as a dashed line and arranged along the first direction 5. In FIG. 24B, the maximum difference between the center points in the direction perpendicular to the first direction is shown as P and the maximum width of the groove is shown as $W_{max}$. the P is less than the $W_{max}$. In both of the cases, the groove 3 has the meander shape. Both cases also can remove the sharpening residue 16 smoothly to the outside of the sharpening member 3.

As described above, the grooves 3*a* are substantially parallel to the first direction 5. Accordingly, the sharpening residue 16 can be easily removed. In this manner, since the cutting edge 15*a* is arranged substantially perpendicularly to the first direction 5 during sharpening, occurrence of a phenomenon, in which the cutting edge 15*a* is stacked in the groove 3*a* and hence the cutting edge 15*a* is nicked, can be reduced.

As described above, the grooves 3*a* are substantially parallel to the first direction 5. The arrangement of the grooves 3*a* is not limited thereto. For example, but without limitation, part of the grooves 3*a* may be inclined to the first direction 5 in plan view, and the like.

A number of the grooves 3*a* may be one or more. If the number of the grooves 3*a* is more than one, the interval P between the adjacent grooves 3*a* and the width W1 of the grooves 3*a* each do not have to be uniform. For example, the interval P between the adjacent grooves 3*a* and the width W1 of the grooves 3*a* each may have different values.

Referring to FIG. 8, the interval P between the adjacent grooves 3*a* is larger than the width W1 of the grooves 3*a*. Accordingly, the area of the sharpening surface 3*d* is sufficiently provided in the sharpening member 3, and hence a sharpening speed can be substantially maintained at or above a set speed.

Referring to FIGS. 6 and 7, the grooves 3*a* are continuously arranged from a first end 31 to a second end 32 of the sharpening member 3 along the first direction 5. Accordingly, the sharpening residue 16 can be efficiently removed to the outside. The grooves 3*a* may be partly intermittent.

Also, as described above, the sharpening member 3 is a columnar member, and comprises the flat portion 3*b* and the curved portion 3*c*. Thus, the sharpening member 3 comprises a flat sharpening surface 3*d*1 that is a flat surface along the first direction 5, and a curved sharpening surface 3*d*2 that is a convex surface along the first direction 5.

Owing to this, the sharpening surface 3*d* of the sharpening member 3 can be desirably properly used in accordance with the shape of the cutting edge 15*a*. Likelihood of appearance of spots on the cutting edge 15*a* is decreased, and smooth sharpening is provided.

In particular, by selecting the sharpening surface for sharpening from the flat sharpening surface 3*d*1 and the curved sharpening surface 3*d*2, the pressure exerted by the sharpening surface 3*d*, which is in contact with the cutter 15 can be adjusted, and sharpening can be performed in accordance with a fine and complex shape of the cutting edge 15*a*.

Accordingly, likelihood of appearance of spots on the cutting edge 15*a* of the cutter 15 is decreased, and smooth sharpening is provided.

As shown FIGS. 4 and 5, the sharpening surface 3*d* comprises the flat sharpening surface 3*d*1 and the curved sharpening surface 3*d*2. However, the sharpening surface 3*d* is not limited thereto. The sharpening surface 3*d* may comprise a plurality of curved sharpening surfaces with different curvature radiuses.

Material of the sharpening member 3 may be any material as long as the material can be used as a sharpening stone. The sharpening member 3 may be made from, for example but without limitation, alumina ceramic, silicon nitride, or the like. Accordingly, the sharpening member 3 can have a higher hardness than that of a metal knife, and have good wear resistance. Thus, the life of the sharpening subject as a sharpening stone can be increased. In this example embodiment, the sharpening member 3 may comprise a base made of alumina or silicon nitride and diamond abrasive grains adhering on the surface of the base. Accordingly, the sharpening member 3 can be used for sharpening a ceramic knife.

Figure 9A:
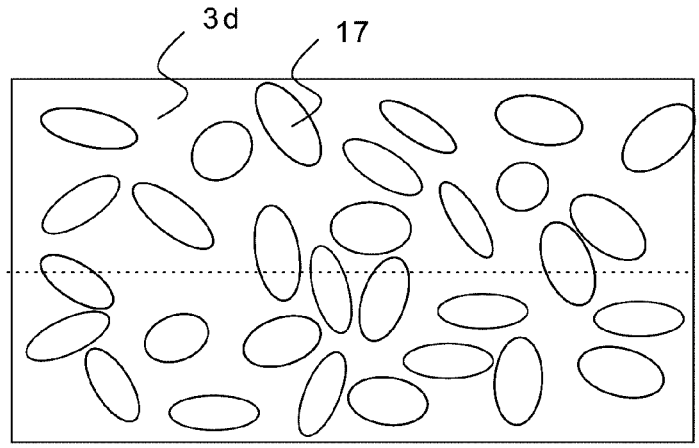
FIG. 9A is an illustration of an enlarged schematic view of a sharpening surface according to an embodiment of the present disclosure, showing a state of the sharpening surface with insufficient open pores.
Figure 9B:
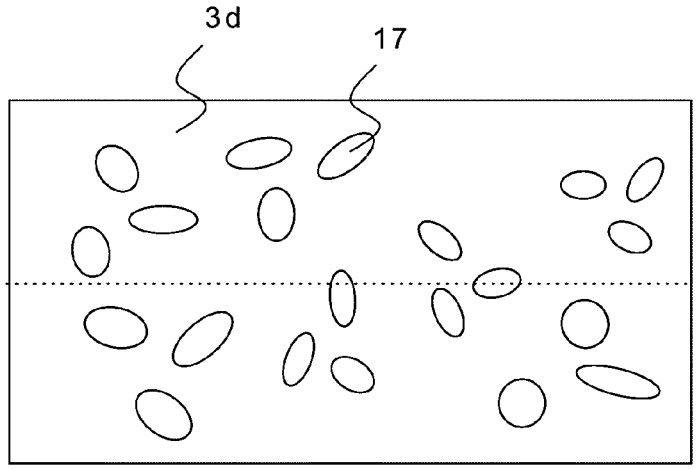
FIG. 9B is an illustration of a state of a sharpening surface with insufficient open pores.
Figure 9C:
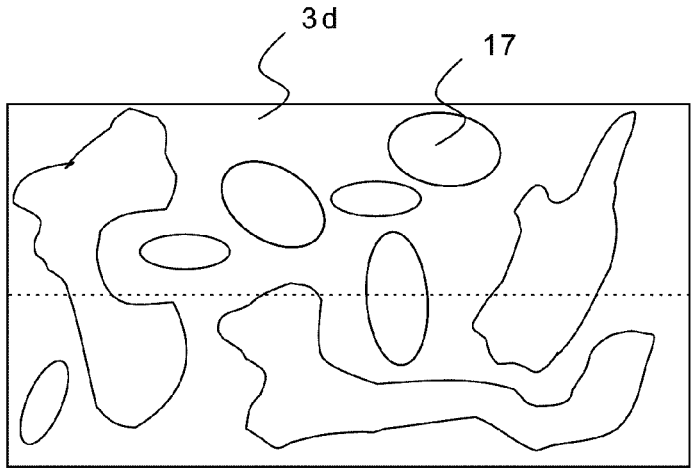
FIG. 9C is an illustration of a state of a sharpening surface with excessive open pores.

FIGS. 9A to 9C schematically illustrate in an enlarged view of sharpening surfaces. FIG. 9A is an illustration of a state of the sharpening surface 3*d* of the sharpening member 3 according to an embodiment of the present disclosure. Referring to the FIG. 9A, a sharpening surface 3*d* comprises open pores 17. If a number of times an arbitrary line in the sharpening surface 3*d* intersects with an edge portion of the open pore 17, hereinafter referred to as N, is larger, the sharpening speed becomes higher.

The N can be determined by observation of the sharpening surface 3*d* with an X-ray microanalyser. A secondary electron image magnified 100 times of any area on the sharpening surface 3*d* is observed to count the N. The N can be counted in a region 1 mm by 2 mm of the sharpening surface 3*d*. FIG. 9A is the secondary electron image of the region 1 mm by 2 mm of the sharpening surface 3*d*. As shown in FIG. 9A, the arbitrary line shown as a dashed line has a length of about 2 mm in the region and the N may be from about 9 to about 11. In addition, the radius of the pore may be about 0.05 mm. In this case, the sharpening speed can be reached sufficient value. Accordingly, the sharpening member 3 can provide good sharpening performance.

The sharpening member 3 may have a porosity ranging from about 10% to about 30%.

If the porosity is within the range, edge portions of the open pores 17 intersecting with the arbitrary line, that is, effectively making a contribution to sharpening performance can be sufficiently provided, the sharpening speed can be maintained, and stable cutting quality can be provided. In the case shown in FIG. A9, the porosity may be around 20%.

Alternatively, the porosity may range from about 0.2% to about 2%. In this case, the sharpening member 3 can have a predetermined hardness. Accordingly, wear of the sharpening member 3 can be decreased. The sharpening member 3 having such a porosity may be fabricated by, for example but without limitation, press molding.

The porosity can be measured as an apparent porosity complying with a testing method (e.g., JIS C2141-1992) by using a tablet with a diameter of about 17 mm.

Figure 10:
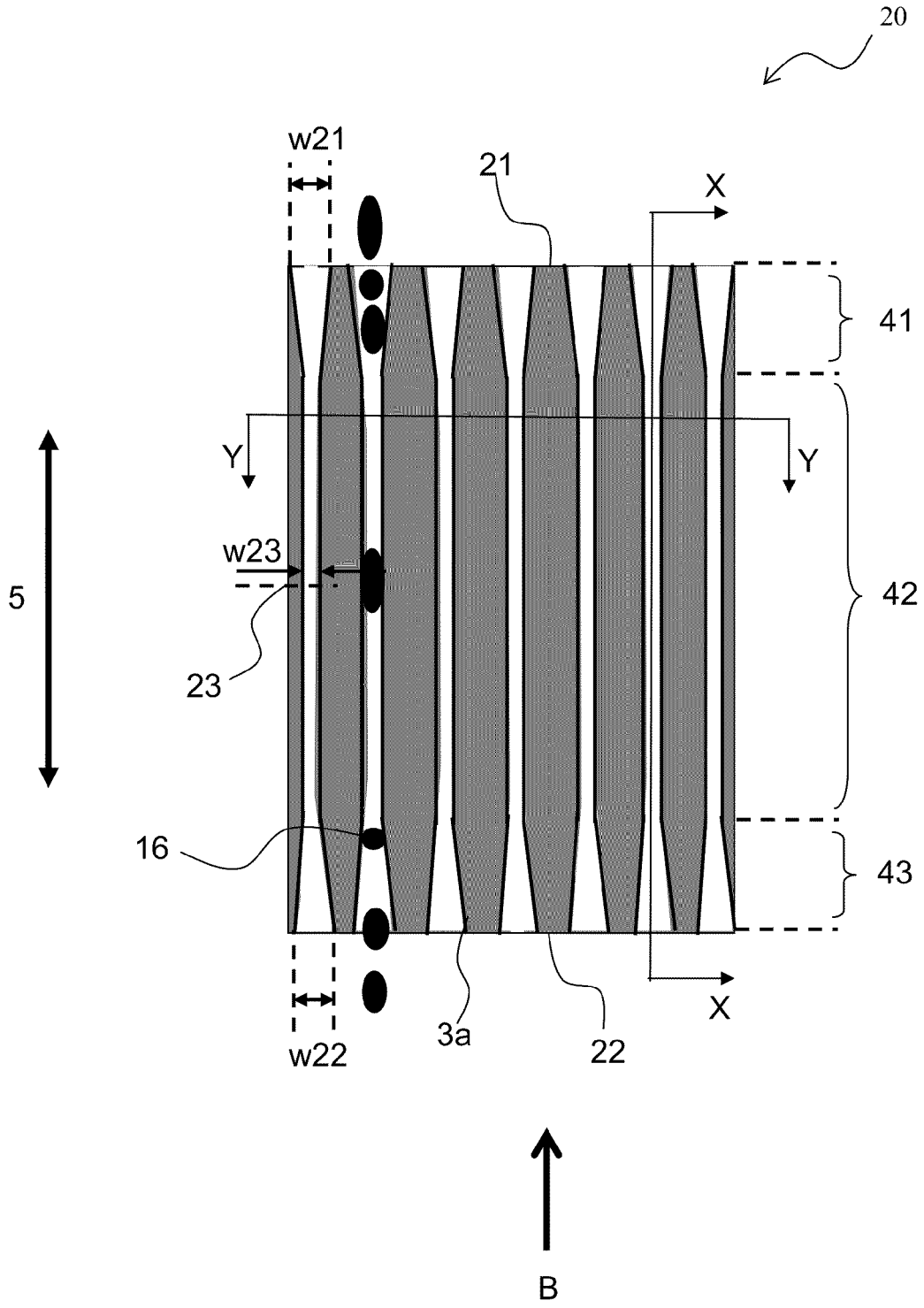
FIG. 10 is an illustration of a plan view of an exemplary sharpening member according to an embodiment of the present disclosure.
Figure 11A:
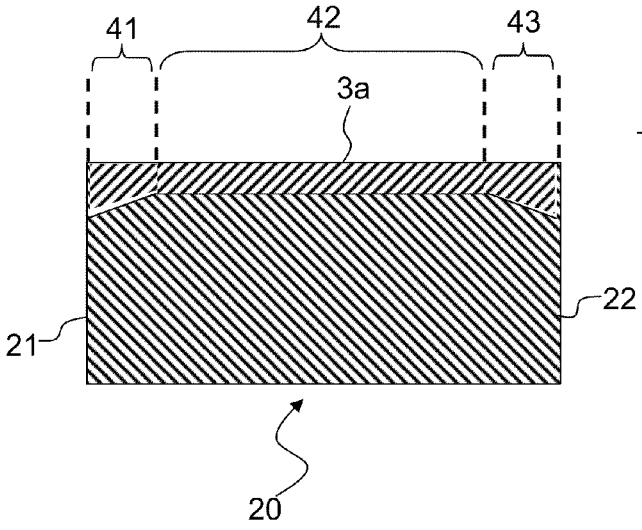
FIG. 11A is an illustration of a sectional view taken along line X-X of the sharpening member shown in FIG. 10.
Figure 11B:
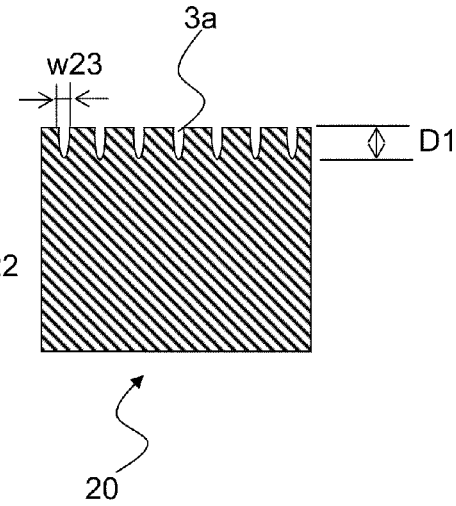
FIG. 11B is an illustration of a sectional view taken along line Y-Y of the sharpening member shown in FIG. 10.

FIG. 10 is an illustration of a top view of an exemplary sharpening member 20 according to an embodiment of the present disclosure. FIG. 11A is an illustration of a sectional view taken along line X-X in FIG. 10. FIG. 11B is an illustration of a sectional view taken along line Y-Y in FIG. 10. Embodiments shown in FIGS. 10-11B may have functions, material, and structures that are similar to the embodiments shown in FIGS. 4-8. Therefore common features, functions, and elements may not be redundantly described here.

The sharpening member 20 has grooves 3*a*. Regarding the width W1 of the grooves 3*a*, widths w21 and w22 at first and second ends 21 and 22 are larger than a width w23 at a center 23 (w21>w23, w22>w23).

Thus, sharpening residue 16 deeply entering the grooves 3*a* can be easily removed as shown in FIG. 10. The amount of the sharpening residue 16 staying in the grooves 3*a* can be decreased. As a result, a stable sharpening speed and a stable sharpening angle can be obtained. For example, the widths w21 and w22 of the grooves 3*a* may be twice to fourfold the width w23 of the grooves 3*a*.

Referring to FIG. 10, the sharpening member 20 comprises a first portion 41, a center portion 42, and a second portion 43 in that order from the first end 21. In the first portion 41, the width W1 of the grooves 3*a* increases toward the first end 21. In the center portion 42, the width W1 of the grooves 3*a* is uniform. In the second portion 43, the width W1 of the grooves 3*a* increases toward the second end 22.

That is, the center portion 42 of the sharpening member 20 has the region in which the width W1 of the grooves 3*a* is uniform. Accordingly, since a contact area between a cutting edge 15*a* and the sharpening surface 3*d* of the sharpening member 20 can be sufficiently provided, the sharpening speed is decreased less.

Further, referring to FIG. 11A, regarding the depth D1 of the grooves 3*a*, depths d21 and d22 at the first and second ends 21 and 22 of the sharpening member 20 are larger than a depth d23 at the center 23 of the sharpening member 20 (d21>d23, d22>d23).

Accordingly, the sharpening residue 16 in the grooves 3*a* can be easily removed, and the amount of sharpening residue 16 staying in the grooves 3*a* can be decreased. As a result, a stable sharpening speed and a stable sharpening angle can be obtained. For example, the depths d21 and d22 of the grooves 3*a* may be twice to fourfold the depth d23 of the grooves 3*a*.

To be more specific, in the first portion 41, the depth D1 of the grooves 3*a* increases toward the first end 21. In the center portion 42, the depth D1 of the grooves 3*a* is uniform. In the second portion 43, the depth D1 of the grooves 3*a* increases toward the second end 22.

That is, the center portion 42 of the sharpening member 20 has the region in which the width W1 and the depth D1 of the grooves 3*a* are uniform.

Further, referring to FIG. 11B, the grooves 3*a* comprise curved bottom portions in sectional view perpendicular to the first direction 5.

Accordingly, the sharpening residue 16 in the grooves 3*a* can be easily removed without being hooked in midcourse. The sharpening residue 16 does not stay in the grooves 3*a*, and a stable sharpening speed and a stable sharpening angle can be obtained.

Figure 11C:
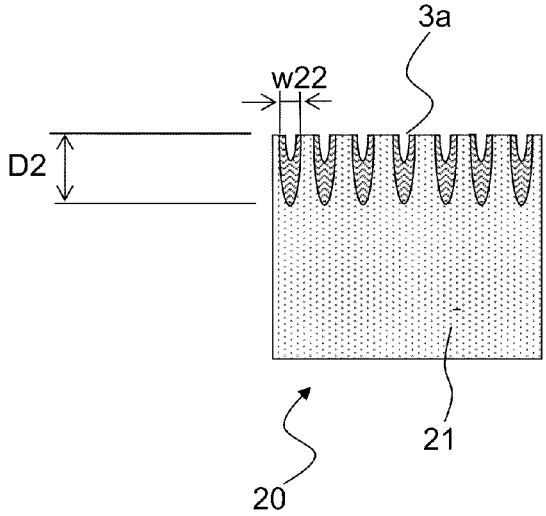
FIG. 11C is an illustration of a front view of the sharpening member shown in FIG. 10 when viewed in a direction indicated by arrow B.

Referring to FIGS. 11B and 11C, the bottom portions of the grooves 3*a* are curved at both of the first end 21 and the center portion 42. Also at the second end 22, the bottom portions of the grooves 3*a* are curved. That is, the bottom portions are curved anywhere in the first direction 5. The shape of the bottom portions of the grooves 3*a* is not limited thereto. For example, the bottom portions of the grooves 3*a* may be, for example but without limitation, at least curved at both ends (the first end 21, the second end 22) of the sharpening member 20, and the like.

The grooves 3*a* comprising such bottom portions may be fabricated by, for example but without limitation, cutting, processing with a die or a laser, and the like. Processing with a die or a laser easily performs processing of the grooves 3*a* comprising such bottom portions.

Figure 12:
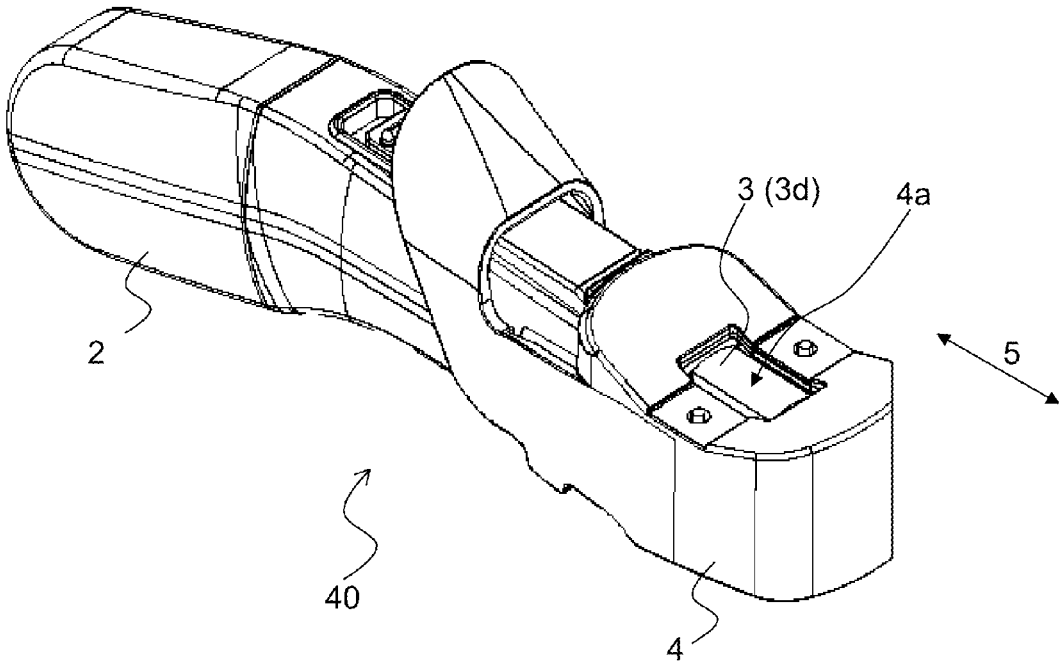
FIG. 12 is an illustration of a perspective view of an exemplary sharpener according to an embodiment of the present disclosure.
Figure 13:
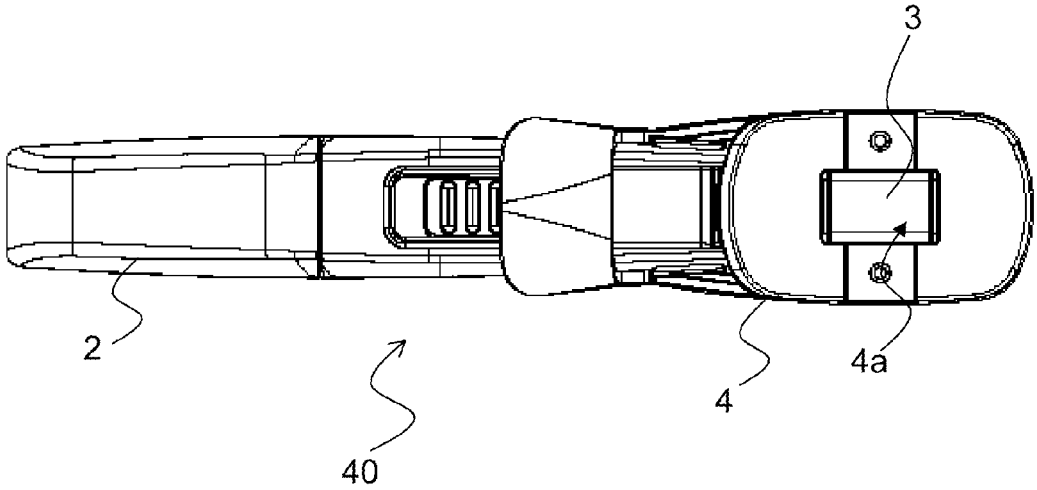
FIG. 13 is an illustration of a top view of the sharpener shown in FIG. 12.
Figure 14:
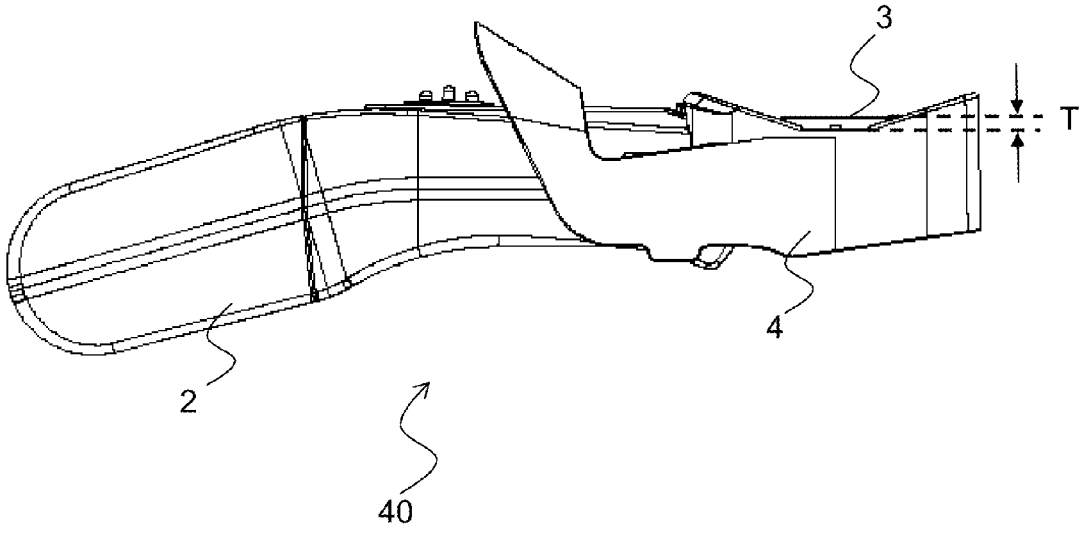
FIG. 14 is an illustration of a side view of the sharpener shown in FIG. 12.

FIG. 12 is an illustration of a perspective view showing an exemplary sharpener 40 according to an embodiment of the present disclosure. FIG. 13 is an illustration of a top view of the sharpener 40. FIG. 14 is an illustration of a side view of the sharpener 40. Embodiments shown in FIGS. 12-14 may have functions, material, and structures that are similar to the embodiments shown in FIGS. 4-8. Therefore common features, functions, and elements may not be redundantly described here.

The sharpener 40 comprises a sharpening member 3 and a protector 4 surrounding the sharpening member 3. The protector 4 comprises an opening 4*a*. Part of the sharpening surface 3*d* of the sharpening member 3 is exposed to the outside through the opening 4*a*.

Thus, a cutting edge 15*a* can contact a predetermined portion of the sharpening surface 3*d* in the sharpening member 3. That is, the cutting edge 15*a* can selectively contact the sharpening surface 3*d* exposed through the opening 4*a*. Likelihood of appearance of spots on the cutting edge 15*a* is decreased, and smooth sharpening is provided.

Since the predetermined portion of the sharpening surface 3*d* of the sharpening member 3 is exposed through the opening 4*a*, the positional relationship between the cutting edge 15*a* and the sharpening surface 3*d* can become stable. Accordingly, the predetermined portion of the sharpening surface 3*d* of the sharpening member 3 can be used for sharpening.

Referring to FIG. 12, the shape of the opening 4*a* is based on the profile of the sharpening member 3 in plan view. That is, a profile of the sharpening member 3 is similar to a profile of the opening 4*a*.

Accordingly, a gap between the sharpening member 3 and the opening 4*a* can be decreased. Occurrence of a phenomenon, in which the edge of the cutter 15 enters the gap, can be decreased.

To be more specific, the opening 4*a* may have dimensions of approximately about 20 to about 30 mm (vertical)× about 12 to about 16 mm (horizontal).

Referring to FIG. 14, the protector 4 is coupled to a grip 2 such that the sharpening surface 3*d* protrudes from the opening 4*a*. That is, the sharpening surface 3*d* is arranged separately from the virtual plane of the opening 4*a* by a protruding amount T.

Accordingly, the cutter 15 can contact the predetermined portion (the flat portion 3*b* and the curved portion 3*c*) of the sharpening surface 3*d* first. In this manner, a likelihood of appearance of spots on the cutting edge 15*a* is decreased, and smooth sharpening is provided. This is because a variation in pressure between the cutter 15 and the sharpening member 3 due to instantaneous contact between the cutter 15 and the protector 4 during sharpening can be decreased.

The protruding amount T of the sharpening member 3 may range from about 0.5 to about 1 mm in view of workability.

Figure 15:
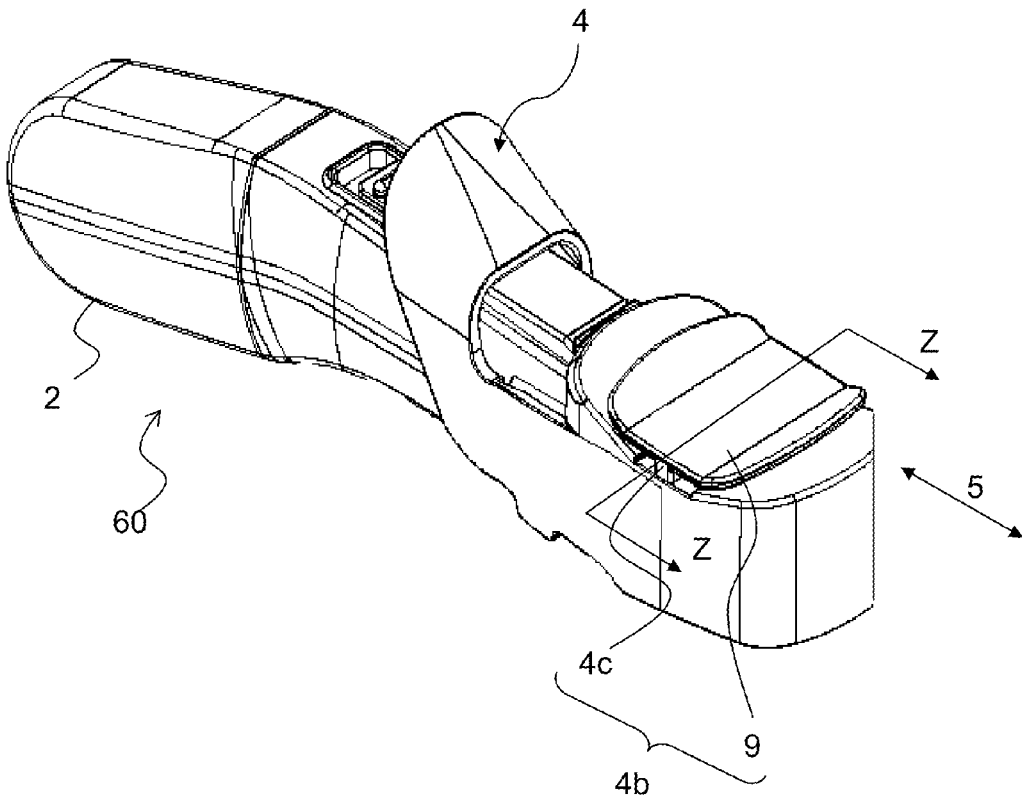
FIG. 15 is an illustration of a perspective view of an exemplary sharpener according to an embodiment of the present disclosure.
Figure 16:
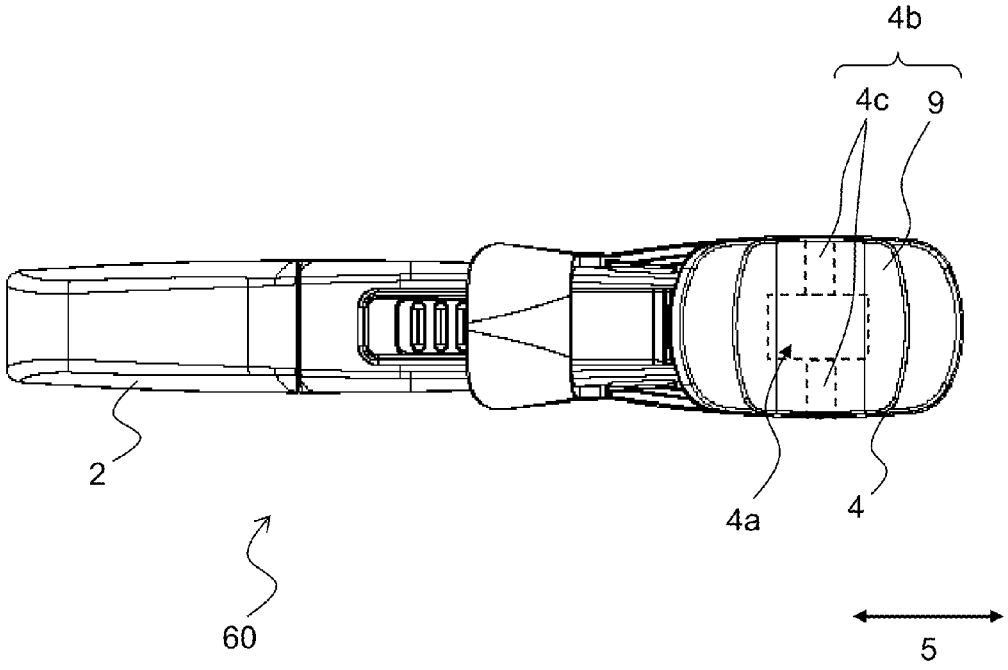
FIG. 16 is an illustration of a top view of the sharpener shown in FIG. 15.
Figure 17:
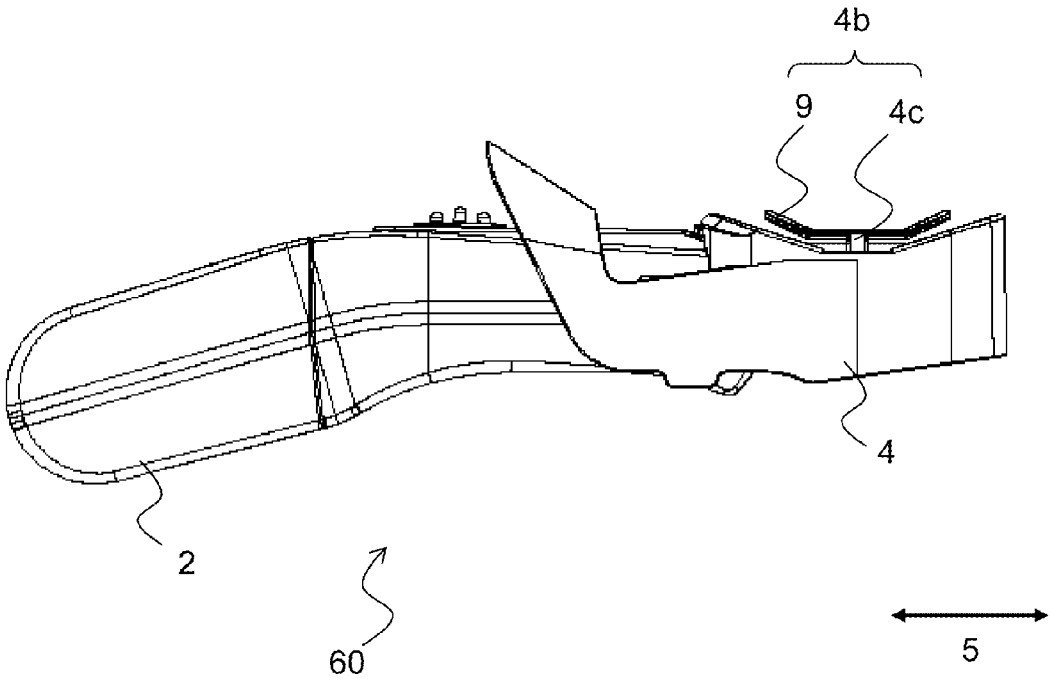
FIG. 17 is an illustration of a side view of the sharpener shown in FIG. 15.
Figure 18:
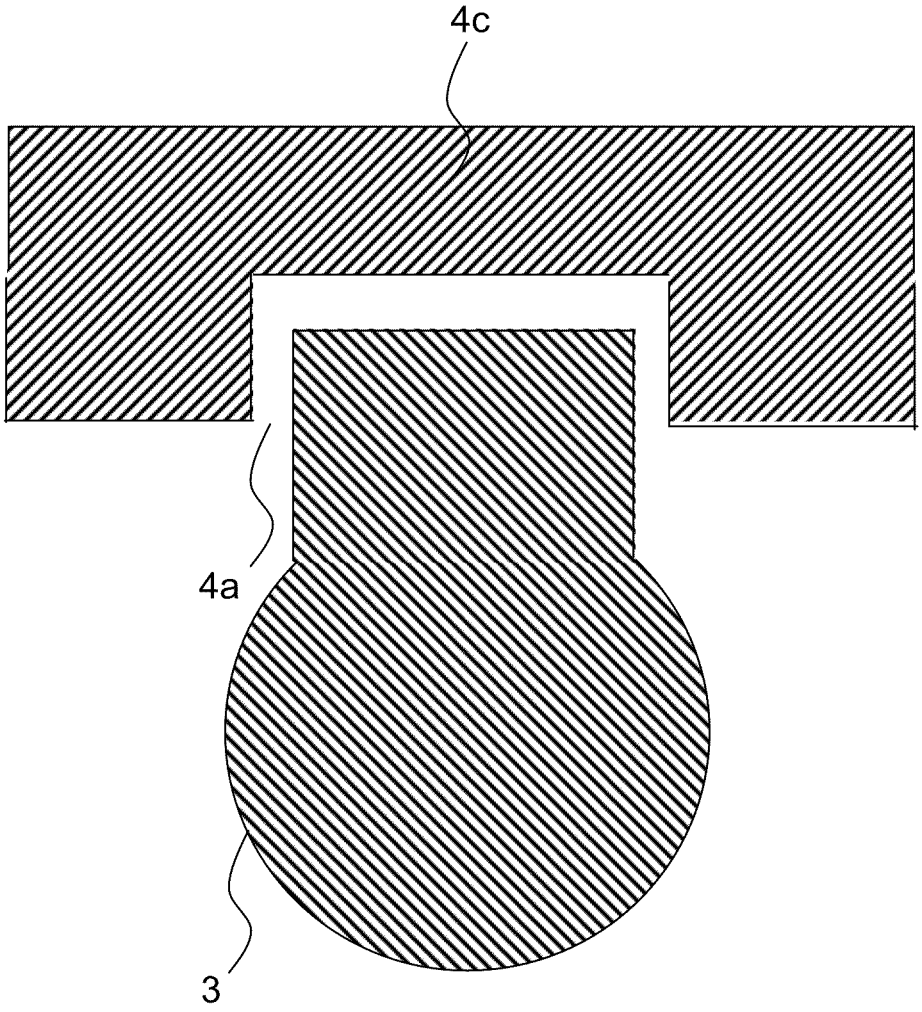
FIG. 18 is an illustration of an enlarged sectional view taken along line Z-Z in FIG. 15, FIG. 18 illustrating the relationship between a partition structure of a guide plate and a sharpening member.
Figure 19A:
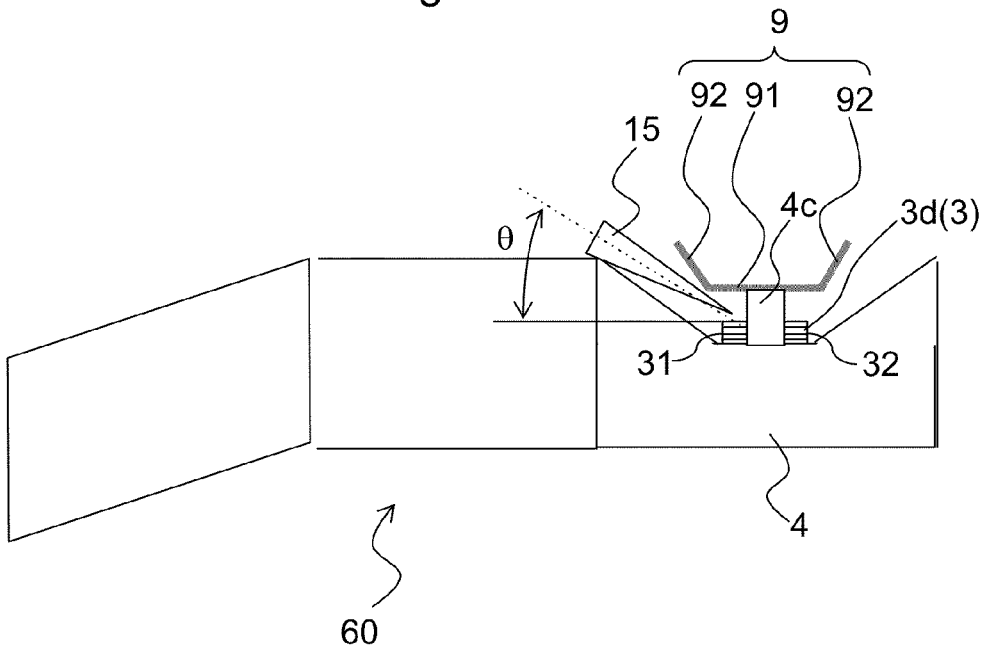
FIG. 19A is an illustration of a side view briefly showing a sharpening state when a portion near a first end of the sharpener shown in FIG. 15 is used.
Figure 19B:
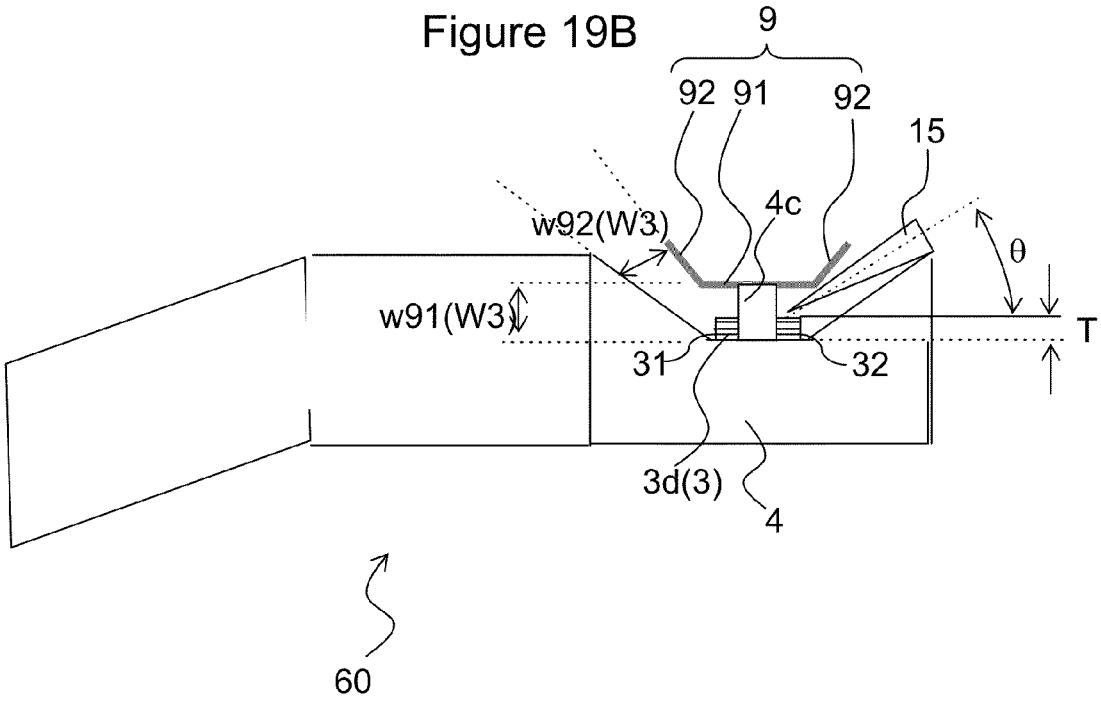
FIG. 19B is an illustration of a side view briefly showing a sharpening state when a portion near a second end of the sharpener shown in FIG. 15 is used.
Figure 20A:
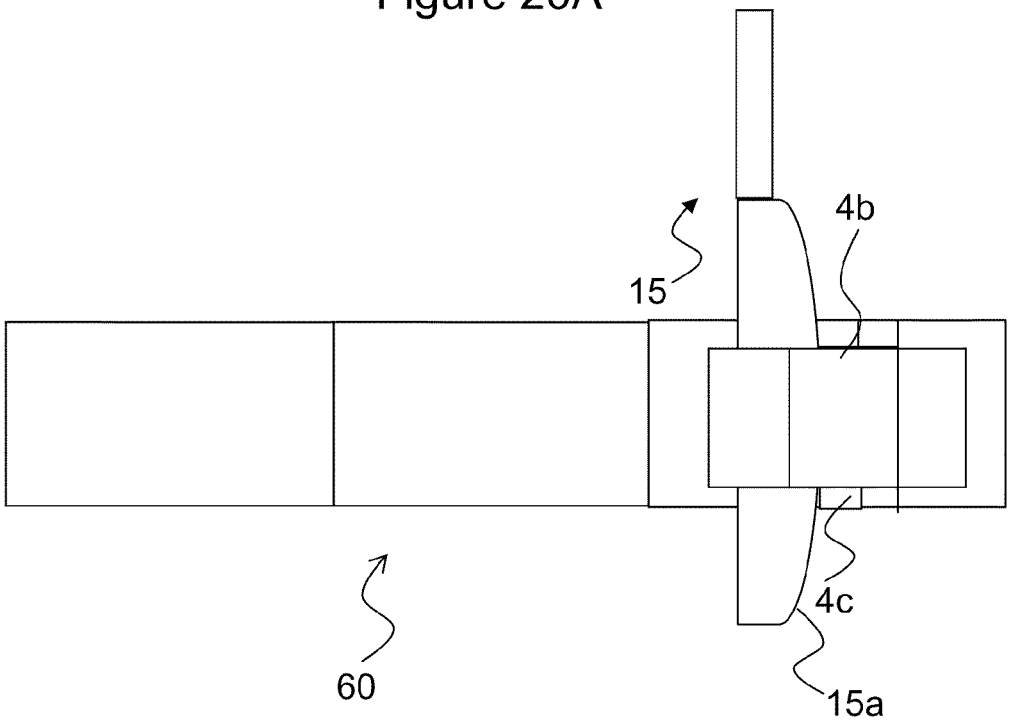
FIG. 20A is an illustration of a top view of FIG. 19A.
Figure 20B:
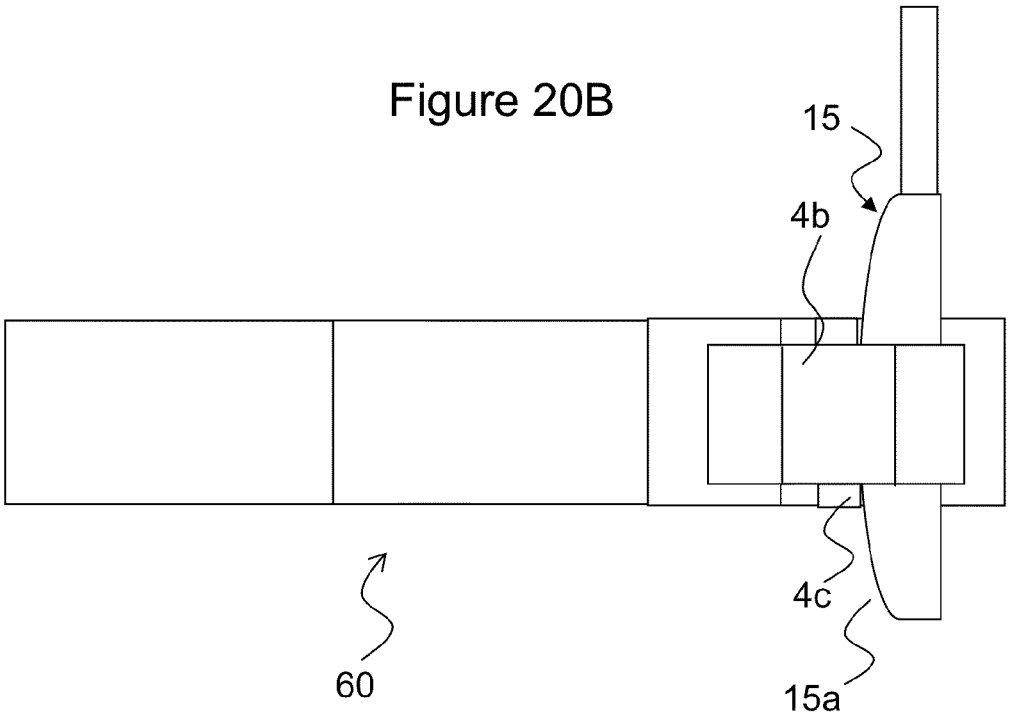
FIG. 20B is an illustration of a top view of FIG. 19B.

FIG. 15 is an illustration of a perspective view showing an exemplary sharpener 60 according to an embodiment of the present disclosure. FIG. 16 is an illustration of a top view of the sharpener 60. FIG. 17 is a side view of the sharpener 60. FIG. 18 is a sectional view taken along line Z-Z in FIG. 15. FIGS. 19A, 19B, 20A, and 20B briefly illustrate sharpening states when a sharpener 60 is used. FIG. 19A is a side view in a direction indicated by arrow C in FIG. 15. FIG. 19B is a side view in a direction indicated by arrow D in FIG. 15. FIGS. 20A and 20B are top views of the sharpener 60 respectively corresponding to FIGS. 19A and 19B. Embodiments shown in FIGS. 15-20B may have functions, material, and structures that are similar to the embodiments shown in FIGS. 1-3 and 12-14. Therefore common features, functions, and elements may not be redundantly described here.

Referring to FIGS. 15 to 17, the sharpener 60 comprises a guide plate 4*b*. The guide plate 4*b* comprises a plate portion 9 facing the opening 4*a* and a support member 4*c* supporting the plate portion 9. A gap separates the plate portion 9 from the opening 4*a*. Referring to FIGS. 16, 19A and 19B, the plate portion 9 comprises a bottom portion 91 and flap portions 92 on both sides of the bottom portion 91. The bottom portion 91 is located above the opening 4*a* and faces the sharpening surface 3*d*. The support member 4*c* is located on the protector 4, and supports the bottom portion 91 of the guide plate 4*b*.

Referring to FIGS. 17 to 19B, the support member 4*c* divides the sharpening surface 3*d* of the sharpening member 3 exposed through the opening 4*a* into two regions in the first direction 5. A cutter 15 contacts one of the two regions of the sharpening surface 3*d* divided by the support member 4*c* from a first end 31 or a second end 32 of the sharpening member 3. In other words, the support member 4*c* comprises a partition structure that divides the opening 4*a* into a portion near the first end 31 and a portion near the second end 32. Specifically, referring to FIGS. 16 to 19B, the support member 4*c* comprises two parts located on both sides of the opening 3*a* in the direction perpendicular to the first direction 5. The two parts of the support member 4 each have columnar shape and are arranged perpendicular to the first direction 5.

Accordingly, the two parts of the support member 4*c* guide the cutting edge 15*a* stably to the arrangement substantially perpendicular to the first direction 5. Therefore, occurrence of a phenomenon, in which the cutting edge 15*a* is stacked in the groove 3*a* and hence the cutting edge 15*a* is nicked, can be reduced as well as the sharpening residue 16 can be removed easily during sharpening. In addition, a direction in which the cutter 15 contacts the sharpening member 3, and a pressure of the cutter 15 to the sharpening member 3 can become stable. In this manner, likelihood of appearance of spots on the cutting edge 15*a* is decreased, and smooth sharpening is provided.

Since the cutter 15 is guided to a position between the sharpening member 3 and the guide plate 4*b*, the motion of the cutter 15 can be easily restricted within a proper range. That is, the cutting edge 15*a* of the cutter 15 is guided by the guide plate 4*b* including the support member 4*c*, and hence, the cutting edge 15*a* can stably contact the sharpening surface 3*d* of the sharpening member 3.

The gap W3 between the guide plate 4*b* and the opening 4*a* may range from about 1 to about 2 mm. Referring to FIGS. 19A and 19B, the gap W3 may be narrowed toward the support member 4*c*. For example, a gap w91 between the bottom portion 91 and the protector 4 may be uniform, and a gap w92 between the flap portions 92 and the protector 4 may be narrowed toward the support member 4*c*.

Further, as described above, the guide plate 4*b* comprises the support member 4*c* that divides the sharpening surface 3*d* exposed through the opening 4*a* into the portion near the first end 31 and the portion near the second end 32.

When one face of the cutting edge 15*a* is sharpened at the side of the first end 31, the cutting edge 15*a* is directed to the second end 32 as shown in FIG. 20A. When the other face of the cutting edge 15*a* is sharpened at the side of the second end 32, the cutting edge 15*a* is directed to the first end 31 as shown in FIG. 20B. Accordingly, both faces of the cutter 15 can be easily sharpened while a user uses a dominant hand. The cutting edge 15*a* is hardly moved beyond the support member 4*c*.

A size of the gap W3 between the guide plate 4*b* and the opening 4*a* may be adjustable.

Accordingly, likelihood of appearance of spots on the cutting edge 15*a* is decreased for the cutter 15 having any of various shapes, and smooth sharpening is provided. This is because the angle θ defined by the center line of the cutter 15 and the sharpening surface 3*d* of the sharpening member 3 can be adjusted through adjustment for the gap W3, for example, by replacing the guide plate 4*b* with another one.

In the viewpoint of durability of the cutting quality, the angle θ defined by the center line and the sharpening surface 3*d* in sectional view of the cutter 15 may range from about 10° to about 20°. When the cutter 15 to be sharpened comprises two types of edges including a large blade and a small blade, the guide plate 4*b* may be selected accordingly. A guide plate 4*b* for the large edge may have an angle θ ranging from about 5° to about 10°, and a guide plate 4*b* for the small edge may have an angle θ ranging from about 20° to about 30°.

Figures 21A, 21B, 21C:
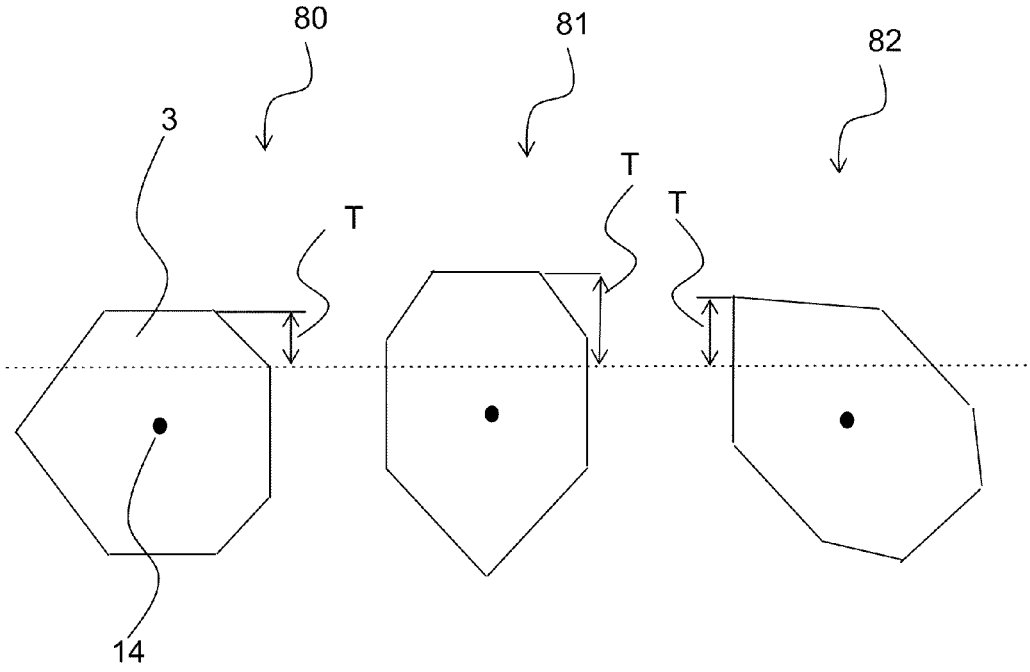
FIGS. 21A to 21C are illustrations of sectional views briefly illustrating protruding amounts of sharpening members when the sharpening members are rotated according to an embodiment of the present disclosure.

FIGS. 21A to 21C are illustrations of sectional views briefly showing sharpening members 80, 81, and 82 according to an embodiment of the present disclosure. Embodiments shown in FIGS. 21A-21C may have functions, material, and structures that are similar to the embodiments shown in FIGS. 2-8 and 12-14. Therefore common features, functions, and elements may not be redundantly described here.

The sharpening members 80, 81, and 82 are rotational members each comprising a plurality of flat surfaces at a plurality of distances from a corresponding central axis 14. The flat surfaces are used for sharpening.

The central axis 14 is substantially parallel to the first direction 5. A protruding amount T of each of the sharpening members 80, 81, and 82 can be adjusted when each of the sharpening members 80, 81, and 82 is rotated around the corresponding central axis 14 as the axis as shown in FIGS. 21A to 21C. The protruding amount T is the amount by which a corresponding sharpening surface 3*d* protrudes from the virtual plane of the opening 4*a*. In FIGS. 21A to 21C, the virtual plane of the opening 4*a* is indicated by a dotted line.

By adjusting the protruding amount T, by which the sharpening member 3 protrudes from the virtual plane of the opening 4*a*, the angle θ can be adjusted.

Further, the plurality of flat surfaces of each of the sharpening members 80, 81, and 82 may comprise at least two types of the sharpening surfaces 3*d* with different porosities. In particular, the sharpening members 80, 81, and 82 may be columnar members each including a plurality of the sharpening surfaces 3*d* with different porosities extending along the first direction 5.

Accordingly, by rotating each of the sharpening members 80, 81, and 82 around the corresponding central axis 14, the sharpening surfaces 3*d* of each sharpening member can be selectively used for rough sharpening and fine sharpening.

Figures 22A, 22B:
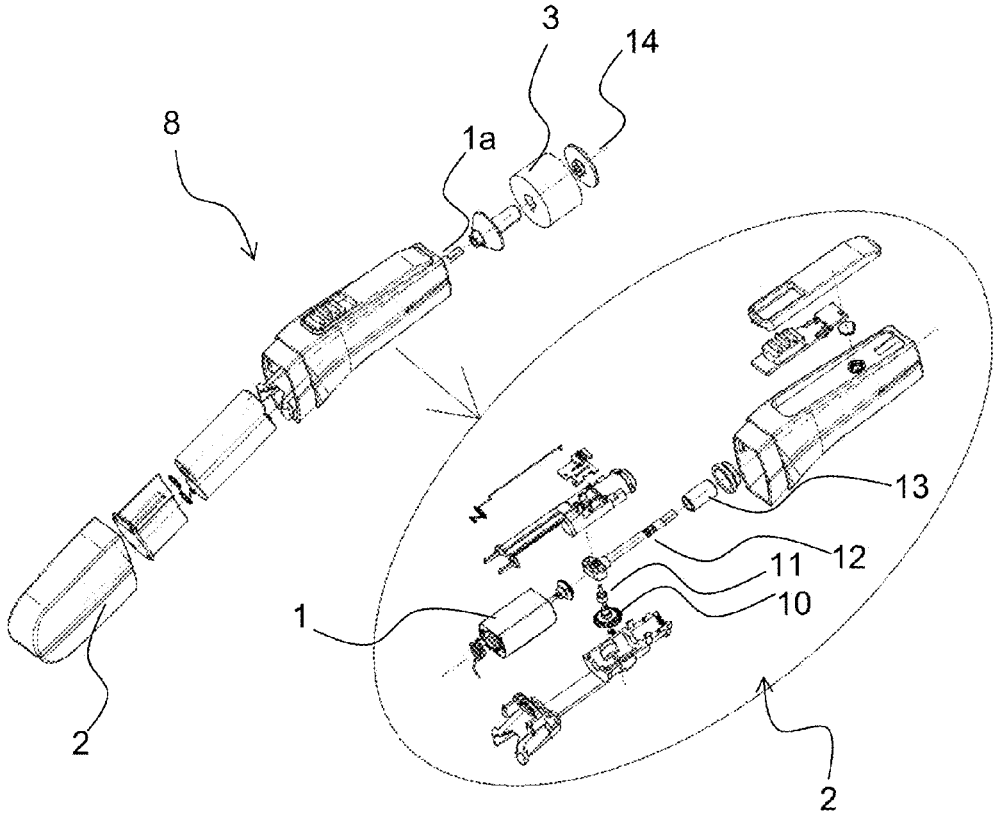
FIG. 22A is an illustration of an exploded perspective view of an exemplary sharpener according to an embodiment of the present disclosure.
FIG. 22B is an illustration of an exploded perspective view of a grip of the sharpener shown in FIG. 22A.

FIG. 22A is an illustration of an exploded perspective view of an exemplary sharpener 8. FIG. 22B is an illustration of an exploded perspective view showing the inside of a grip 2 of the sharpener 8.

The sharpener 8 comprises an electric motor 1, a gear 10, an elliptic cam 11, a shaft 12, and a sleeve 13. Rotation of the electric motor 1 is converted into linear reciprocation by the gear 10 and the elliptic cam 11. The shaft 12 is connected to the elliptic cam 11. The shaft 12 is connected to a sharpening member 3 through the sleeve 13.

The motion substantially perpendicular to the first direction 5 of the shaft 12 is restricted by the sleeve 13. The shaft 12 can cause the sharpening member 3 to reciprocate while the sharpening member 3 is stably held. Accordingly, a sharpening force can be generated.

Further, the frequency of the reciprocation of the sharpening member 3 may be adjusted by changing a ratio of rotation of the elliptic cam 11 to rotation of the gear 10.

Accordingly, the sharpening speed can be selected depending on the situation for rough sharpening or for fine sharpening.

The frequency of the reciprocation of the sharpening member 3 may range from about 20 to about 300 Hz. Accordingly, the resonation of the cutter 15 can be decreased, and sonic oscillation that allows sharpening residue 16 to be smoothly removed can be obtained. Also, the cutting edge 15*a* is less hooked to the sharpening member 3 during sharpening. Appearance of sharpening unevenness of the cutting edge 15*a* can be decreased.

The amplitude of the reciprocation of the sharpening member 3 may be, for example but without limitation, about 0.5 mm, and the like. Accordingly, the removing performance for the sharpening residue 16 is increased, and decrease in life of the sharpening member 3 due to wear can be decreased.

Figure 23:
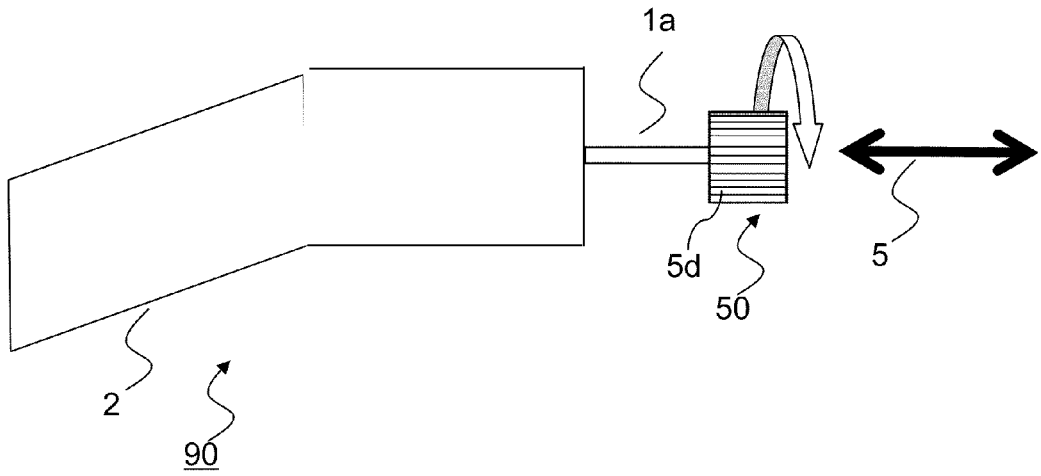
FIG. 23 is an illustration of a front view of an exemplary sharpener according to an embodiment of the present disclosure.

FIG. 23 is an illustration of a perspective view showing an exemplary sharpener 90 according to an embodiment of the present disclosure. The sharpener 90 comprises a sharpening member 50. The sharpening member 50 comprises a plurality of sharpening surfaces 5*d*. Referring to FIG. 23, the sharpening member 50 is a rotational member that is rotatable around an axis along the first direction 5.

Accordingly, an unused sharpening surface 5*d* can be used if the sharpening member 50 is rotated. A stable sharpening speed and a stable sharpening angle can be obtained.

Furthermore, the sharpening member 50 rotates freely around the first direction 5 as the axis.

Accordingly, the sharpening member 3 rotates freely as a user moves the cutting edge. A phenomenon, in which only a certain part of the sharpening surface 5*d* of the sharpening member 50 sharpens the cutter 15, less frequently occurs. A stable sharpening speed and a stable sharpening angle can be obtained.

The sharpening member 50 rotates freely in the example embodiment shown herein. However, rotation of the sharpening member 50 may be controlled automatically around the first direction 5 as the axis.

In this case, the sharpening member 50 is rotated even if the cutting edge is not moved. A phenomenon, in which only a certain part of the sharpening surface 5*d* of the sharpening member 50 sharpens the cutter 15, less frequently occurs. A stable sharpening speed and a stable sharpening angle can be obtained.

Such an automatic rotational mechanism may use a mechanism that allows automatic rotation to be performed in addition to the reciprocation of the output shaft 1*a*. For example, a rotational roller is brought into contact with the output shaft 1*a* and the output shaft 1*a* is automatically rotated, so that the sharpening member 50 is automatically rotated.

The grooves 3*a* may be formed in advance when the sharpening member 3 is molded with a die. Alternatively, the grooves 3*a* may be formed by NC microfabrication.

The grip 2 and the protector 4 may be made from, for example but without limitation, acrylonitrile butadiene styrene (ABS) resin, polypropylene (PP), or polystyrene (PS), and the like.

EXAMPLES

Example 1

Sample Fabrication

Sharpeners with different conditions were fabricated as samples. The conditions of each sample comprised the presence of the grooves 3*a* of a sharpening member 3, the presence of the flat portion 3*b* and the curved portion 3*c*, the presence of a protector 4 comprising the opening 4*a*, a protruding amount T of the sharpening member 3 from the opening 4*a*, the presence of a guide plate 4*b*, and the presence of a support member 4*c*. Table 1 shows the conditions for the sharpeners.

TABLE 1

| Sample | Groove | | Flat surface and curved surface | | Protector and opening | | Protruding amount | Guide plate | | Partition structure | |
|---|---|---|---|---|---|---|---|---|---|---|---|
| No. | Included | Lacking | Included | Lacking | Included | Lacking | (mm) | Included | Lacking | Included | Lacking |
| 1 | ○ | | ○ | | ○ | | 2 | ○ | | ○ | |
| 2 | | ○ | ○ | | ○ | | 2 | ○ | | ○ | |
| 3 | ○ | | | ○ | ○ | | 2 | ○ | | ○ | |
| 4 | ○ | | ○ | | | ○ | — | | ○ | | ○ |
| 5 | ○ | | ○ | | ○ | | 1 | ○ | | ○ | |
| 6 | ○ | | ○ | | ○ | | 0 | ○ | | ○ | |
| 7 | ○ | | ○ | | ○ | | −1 | ○ | | ○ | |
| 8 | ○ | | ○ | | ○ | | 2 | | ○ | | ○ |

TABLE 1-continued

| Sample | Groove | | Flat surface and curved surface | | Protector and opening | | Protruding amount | Guide plate | | Partition structure | |
|---|---|---|---|---|---|---|---|---|---|---|---|
| No. | Included | Lacking | Included | Lacking | Included | Lacking | (mm) | Included | Lacking | Included | Lacking |
| 9 | ○ | | ○ | | ○ | | 2 | ○ | | | ○ |
| 10 | | ○ | | ○ | | ○ | — | | ○ | | ○ |

A sample 3 did not comprise the curved portion 3*c*, but comprised the flat portion 3*b*.

A sample 9 comprised the guide plate 4*b*, but did not comprise the support member 4*c*. Thus, the sample 9 was used for sharpening from one side.

A sample 10 corresponded to an existing grinder, that is, a sharpener like a rotational sharpening stone.

Evaluation Method

The sharpeners under the conditions described in Table 1 were used to sharpen cutting edges 15*a* of metal knifes made of stainless steel.

A sharpening condition was that each of edges of a metal knife was sharpened for 10 seconds. After sharpening, cutting qualities of the metal knifes were compared with one another by the Honda-method cutting tester.

Conditions for the Honda-method cutting test were that a measurement environment was in a hothouse, test paper was good quality paper, a paper shape was 0.038-mm-thick and 8-mm-wide, the number of sheets comprised in a bundle was 400, an application load was about 800 g, and a sliding speed was 20 mm/g. Under the conditions, the test paper was fixed, and the bundle of sheets reciprocates once. Then, the number of cut sheets was measured. Table 2 shows the results.

TABLE 2

| | Cutting quality |
|---|---|
| Sample 1 | ○ |
| Sample 2 | X |
| Sample 3 | ○ |
| Sample 4 | Δ |
| Sample 5 | ○ |
| Sample 6 | Δ |
| Sample 7 | — |
| Sample 8 | Δ |
| Sample 9 | ○ |
| Sample 10 | X |

In Table 2, respective reference signs indicate the numbers of cut sheets, ○ (circle) indicating 100 or more sheets, Δ (triangle) indicating 50 to 99 sheets, X (cross) indicating fewer than 50 sheets.

A sample 1 had the grooves 3*a* in the surface of a sharpening member 3, and the sharpening surface 3*d* at a flat portion 3*b* and a curved portion 3*c*. The sample 1 comprised a protector 4 comprising the opening 4*a*, and had a sufficient value (2 mm) for a protruding amount T of the sharpening member 3. Also, the sample 1 comprised a guide plate 4*b* for holding a cutting edge 15*a* at a predetermined angle θ, and comprised a support member 4*c* capable of adjusting an insertion amount of the cutting edge 15*a* to a position between the guide plate 4*b* and the sharpening member 3. Thus, the sample 1 provided good cutting quality.

A sample 5 comprising a protruding amount T of 1 mm provided good cutting quality in a similar manner to the sample 1 comprising the protruding amount T of 2 mm in a similar manner to the sample 1 with the protruding amount T of 2 mm.

A sample 9 did not comprise a support member 4*c*. A user could not use a dominant hand for one face of the cutter 15, and hence sharpening took a time. However, the sample 9 provided good cutting quality.

In a sample 7, a sharpening member 3 did not protrude. Hence, the sample 7 could not sharpen the entire cutting edge 15*a*. However, the sample 7 could sharpen a tip portion of the cutter 15.

In the sample 7, since a sharpening surface 3*d* did not protrude from the plane of an opening 4*a*, the above-described test for cutting quality was not performed.

Example 2

Table 3 shows the evaluation results of Example 2 which was carried out on the basis of Example 1.

TABLE 3

| Sample No. | Reciprocation direction | Both end width | Both end depth | Groove shape | Free rotation | Automatic rotation | Frequency (Hz) | Cutting quality | Life |
|---|---|---|---|---|---|---|---|---|---|
| 11 | Perpendicular | Large | Large | Parabolic | None | None | 150 | ○ | Δ |
| 12 | Parallel | Large | Large | Parabolic | None | None | 150 | Δ | Δ |
| 13 | Perpendicular | Same | Large | Parabolic | None | None | 150 | Δ | Δ |
| 14 | Perpendicular | Large | Same | Parabolic | None | None | 150 | Δ | Δ |
| 15 | Perpendicular | Large | Large | Rectangular | None | None | 150 | Δ | Δ |
| 16 | Perpendicular | Large | Large | Parabolic | Applied | None | 150 | ○ | ○ |
| 17 | Perpendicular | Large | Large | Parabolic | None | Applied | 150 | ○ | ○ |
| 18 | Perpendicular | Large | Large | Parabolic | None | None | 10 | Δ | ○ |
| 19 | Perpendicular | Large | Large | Parabolic | None | None | 20 | ○ | ○ |
| 20 | Perpendicular | Large | Large | Parabolic | None | None | 300 | ○ | ○ |
| 21 | Perpendicular | Large | Large | Parabolic | None | None | 400 | ○ | Δ |

In particular, in Example 2, on the basis of Example 1 (standard conditions), conditions for samples were changed, and cutting quality and life of the samples were evaluated. The conditions in Table 3 comprised a relationship between the groove 3*a* and a reciprocation direction of a sharpening member 3, a width W1 at both ends of the groove 3*a*, a depth D1 at both ends of the groove 3*a*, a shape of a bottom portion of the groove 3*a*, availability of free rotation of the sharpening member 3 around a first direction 5 as the rotation axis, availability of automatic rotation of the sharpening member 3, and a frequency of the reciprocation of the sharpening member 3.

When a sample 11, in which a first direction 5 was perpendicular to a cutting edge 15*a* during sharpening, was compared with a sample 12, in which a first direction 5 was parallel to a cutting edge 15*a*, the sample 11 had better cutting quality than that of the sample 12.

When a sample 13, in which the groove 3*a* had a width W1 uniform in a first direction 5 of a sharpening member 3, was compared with the sample 11, in which the groove 3*a* had a width W1 increased from a center portion toward both ends in a first direction 5, the sample 11 had better cutting quality and removed sharpening residue 16 more smoothly.

When a sample 14, in which the groove 3*a* had a depth D1 uniform in a first direction 5 of a sharpening member 3, was compared with the sample 11, in which the groove 3*a* had a depth D1 increased from a center portion toward both ends in a first direction 5, the sample 11 had better cutting quality and removed sharpening residue 16 more smoothly.

When a sample 15, in which the groove 3*a* had a rectangular shape in a cross section perpendicular to a first direction 5, was compared with the sample 11, in which the groove 3*a* had a parabolic shape protruding downward, the sample 11 had better cutting quality.

When a sample 16, in which a sharpening member 3 was freely rotated around a first direction 5 as the axis, was compared with the sample 11, in which the sharpening member 3 was fixed to a grip 2, the life of the sharpening member 3 in the sample 16 was longer.

When a sample 17, in which a sharpening member 3 was automatically rotated around a first direction 5 as the axis, was compared with the sample 11, in which the sharpening member 3 was fixed to the grip 2, the life of the sharpening member 3 in the sample 17 was longer.

The embodiment, in which a frequency of reciprocation was in a range from 20 to 300 Hz, provided good cutting quality because decrease in removal stress for sharpening residue 16 was reduced. Thus, the life of a sharpening member 3 was longer.

Example 3

Alumina and silicon nitride were prepared for the materials of sharpening members 3 for samples. The sharpening members 3 with porosities ranging from 9% to 40% were fabricated, and cutting quality was evaluated.

Table 4 shows the results.

TABLE 4

| | Material | Porosity (%) | Cutting quality |
|---|---|---|---|
| Sample 22 | Alumina | 9 | Δ |
| Sample 23 | Alumina | 10 | ○ |
| Sample 24 | Alumina | 30 | ○ |
| Sample 25 | Alumina | 40 | Δ |
| Sample 26 | Silicon nitride | 9 | Δ |
| Sample 27 | Silicon nitride | 10 | ○ |
| Sample 28 | Silicon nitride | 30 | ○ |
| Sample 29 | Silicon nitride | 40 | Δ |

Regarding samples 22 to 29, in samples 23, 24, 27, and 28, edge portions of the pores that make a contribution to sharpening could be provided by sufficient amounts. Hence, sharpening at a good sharpening speed could be provided. Accordingly, efficient sharpening could be provided, and cutting quality was good.

While at least one exemplary embodiment has been presented in the foregoing detailed description, the present disclosure is not limited to the above-described embodiment or embodiments. Variations may be apparent to those skilled in the art. In carrying out the present disclosure, various modifications, combinations, sub-combinations and alterations may occur in regard to the elements of the above-described embodiment insofar as they are within the technical scope of the present disclosure or the equivalents thereof. The exemplary embodiment or exemplary embodiments are examples, and are not intended to limit the scope, applicability, or configuration of the disclosure in any way. Rather, the foregoing detailed description will provide those skilled in the art with a template for implementing the exemplary embodiment or exemplary embodiments. It should be understood that various changes can be made in the function and arrangement of elements without departing from the scope of the disclosure as set forth in the appended claims and the legal equivalents thereof. Furthermore, although embodiments of the present disclosure have been described with reference to the accompanying drawings, it is to be noted that changes and modifications may be apparent to those skilled in the art. Such changes and modifications are to be understood as being comprised within the scope of the present disclosure as defined by the claims.

Terms and phrases used in this document, and variations hereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent. The term "about" when referring to a numerical value or range is intended to encompass values resulting from experimental error that can occur when taking measurements.

The invention claimed is:

1. A sharpener, comprising:

a sharpening member reciprocating in a first direction and comprising a plurality of sharpening surfaces, at least one of the plurality of sharpening surfaces with at least two grooves along the first direction.

2. The sharpener according to claim 1, wherein the groove is substantially parallel to the first direction.

3. The sharpener according to claim 1, wherein the sharpening member has a porosity ranging from about 10% to about 30%.

4. The sharpener according to claim 1, wherein the groove comprises a bottom surface curved in a cross section perpendicular to the first direction.

5. The sharpener according to claim 1, wherein the sharpening surface comprises:

a first surface comprising a flat surface along the first direction; and a second surface comprising a convex and curved surface along the first direction.

6. The sharpener according to claim 1, wherein the sharpening surface comprises at least two types of surfaces with different porosities.

7. The sharpener according to claim 1, wherein the sharpening member is a rotational member rotating freely or automatically around an axis substantially parallel to the first direction.

8. The sharpener according to claim 1, further comprising a protector that surrounds the sharpening member and comprises an opening through which the sharpening surface is operable to be exposed.

9. The sharpener according to claim 8, wherein the sharpening surface is located outside of the opening.

10. The sharpener according to claim 8, further comprising a guide plate located above the opening and facing the opening, wherein a gap separates the guide from the opening.

11. The sharpener according to claim 10, wherein the guide plate comprises a partition structure dividing the opening into a first portion near a first end and a second portion near a second end, wherein the first end and the second end are ends of the sharpening member in the first direction.

12. The sharpener according to claim 10, wherein a size of the gap is adjustable.

13. The sharpener according to claim 1, wherein the sharpening member is a rotational member comprising a central axis and a plurality of flat surfaces at a plurality of distances from the central axis.

14. The sharpener according to claim 1, further comprising:

an electric motor comprising an elliptic cam and a gear, the elliptic cam and the gear operable to convert rotation into linear reciprocation, wherein a frequency of the reciprocation is adjustable by changing a ratio of a rotation of the elliptic cam to a rotation of the gear.

15. The sharpener according to claim 14, wherein the frequency of the reciprocation is from about 20 Hz to about 300 Hz.

16. A sharpener, comprising a sharpening member reciprocating in a first direction and comprising a sharpening surface with a groove along the first direction;

the groove comprising:

a first width in a first end portion at a first end of the sharpening member in the first direction;

a second width in a second end portion at a second end of the sharpening member in the first direction; and a central width in a center portion of the sharpening member between the first end portion and the second end portion in the first direction, wherein at least one of the first width and the second width is larger than the central width.

17. The sharpener according to claim 16, wherein a width of the groove is increased from the center portion toward the first end portion and the second end portion of the sharpening member in the first direction.

18. A sharpener, comprising a sharpening member reciprocating in a first direction and comprising a sharpening surface with a groove along the first direction;

the groove comprising:

a first depth in a first end portion at a first end of the sharpening member in the first direction;

a second depth in a second end portion at a second end of the sharpening member in the first direction; and a central depth in a center portion of the sharpening member between the first end portion and the second end portion in the first direction, wherein at least one of the first depth and the second depth is larger than the central depth.

19. The sharpener according to claim 18, wherein a depth of the groove is increased from the center portion toward the first end portion and the second end portion of the sharpening member in the first direction.

* * * * *